US009491969B2

(12) United States Patent
Tanaka et al.

(10) Patent No.: US 9,491,969 B2
(45) Date of Patent: Nov. 15, 2016

(54) METHOD FOR PREPARING FLAVOR-CONTAINING SHEET FOR SMOKING ARTICLE, FLAVOR-CONTAINING SHEET FOR SMOKING ARTICLE PREPARED BY THE METHOD, AND SMOKING ARTICLE COMPRISING THE SAME

(71) Applicant: JAPAN TOBACCO INC., Tokyo (JP)

(72) Inventors: Yasuo Tanaka, Tokyo (JP); Tatsuya Kusakabe, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 459 days.

(21) Appl. No.: 13/963,821

(22) Filed: Aug. 9, 2013

(65) Prior Publication Data

US 2013/0327347 A1 Dec. 12, 2013

Related U.S. Application Data

(63) Continuation of application No. PCT/JP2012/054828, filed on Feb. 27, 2012.

(30) Foreign Application Priority Data

Mar. 2, 2011 (JP) ..... 2011-045290

(51) Int. Cl.

| | |
|---|---|
| ***A24B 15/34*** | (2006.01) |
| ***B05D 3/04*** | (2006.01) |
| ***A24B 3/12*** | (2006.01) |

(Continued)

(52) U.S. Cl.

CPC ..... *A24B 15/34* (2013.01); *A24B 3/12* (2013.01); *A24B 3/14* (2013.01); *A24B 15/10* (2013.01); *A24B 15/14* (2013.01); *A24B 15/282* (2013.01); *A24B 15/301* (2013.01); *A24B 15/302* (2013.01); *A24B 15/303* (2013.01);

(Continued)

(58) Field of Classification Search

None

See application file for complete search history.

(56) References Cited

U.S. PATENT DOCUMENTS

| | | | |
|---|---|---|---|
| 4,596,259 | A | 6/1986 | White et al. |
| 5,186,185 | A | 2/1993 | Mashiko et al. |

(Continued)

FOREIGN PATENT DOCUMENTS

| | | | |
|---|---|---|---|
| BR | 9609628 | A | 4/1999 |
| CN | 1708241 | A | 12/2005 |

(Continued)

OTHER PUBLICATIONS

Malaysia Office Action dated Nov. 30, 2015 for Application No. PI2013701424.

(Continued)

*Primary Examiner* — Erma Cameron

(74) *Attorney, Agent, or Firm* — Birch, Stewart, Kolasch & Birch, LLP

(57) ABSTRACT

A method for preparing a flavor-containing sheet for a smoking article, characterized by comprising a step of extending a raw material slurry on a substrate, wherein the slurry contains polysaccharide consisting of gellan gum and tamarind gum, a flavor, an emulsifier and 70 to 95 wt % of water, has a weight ratio of gellan gum to tamarind gum of 1:1 to 3:1, and has a temperature of 60 to 90° C. in a sol state, a step of cooling the extended raw material slurry to a sample temperature of 0 to 40° C. to form a gel, and a heat-drying step comprising heating the gelled raw material and drying it at a sample temperature of 70 to 100° C.

7 Claims, 17 Drawing Sheets

(51) Int. Cl.

| | |
|---|---|
| ***A24B 15/30*** | (2006.01) |
| ***B05D 3/02*** | (2006.01) |
| ***A24B 3/14*** | (2006.01) |
| ***A24B 15/28*** | (2006.01) |
| ***A24B 15/10*** | (2006.01) |
| ***A24D 1/00*** | (2006.01) |
| ***A24B 15/14*** | (2006.01) |

(52) U.S. Cl.
CPC ..... *A24D 1/002* (2013.01); *B05D 3/02* (2013.01); *B05D 3/0254* (2013.01); *B05D 3/0426* (2013.01)

(56) References Cited

U.S. PATENT DOCUMENTS

| | | | | |
|---|---|---|---|---|
| 6,109,272 | A | 8/2000 | Saito et al. | |
| 2004/0129280 | A1 | 7/2004 | Woodson et al. | |
| 2005/0244521 | A1* | 11/2005 | Strickland | A23L 1/2205 424/751 |
| 2007/0246054 | A1 | 10/2007 | Gedevanishvili et al. | |
| 2008/0011311 | A1* | 1/2008 | Ojima | A24B 15/243 131/332 |
| 2011/0036367 | A1 | 2/2011 | Saito et al. | |
| 2011/0061667 | A1 | 3/2011 | Tanaka et al. | |
| 2011/0139164 | A1 | 6/2011 | Mua et al. | |
| 2011/0220130 | A1 | 9/2011 | Mua et al. | |
| 2013/0019884 | A1* | 1/2013 | Sashide | A24B 15/283 131/276 |
| 2013/0319430 | A1 | 12/2013 | Tanaka | |
| 2013/0327346 | A1 | 12/2013 | Tanaka et al. | |
| 2013/0327347 | A1 | 12/2013 | Tanaka et al. | |

FOREIGN PATENT DOCUMENTS

| | | | |
|---|---|---|---|
| CN | 101374429 | A | 2/2009 |
| EP | 0 135 266 | A | 11/1988 |
| EP | 2279677 | A1 | 2/2011 |
| EP | 2 289 357 | A1 | 3/2011 |
| JP | 64-027461 | A | 1/1989 |
| JP | 04-075578 | A | 3/1992 |
| JP | 09-028366 | A | 2/1997 |
| JP | 11-113552 | A | 4/1999 |
| JP | 11-509566 | A | 8/1999 |
| JP | 2001-231468 | A | 8/2001 |
| JP | 2007-023065 | A | 2/2007 |
| JP | 4109804 | A | 7/2008 |
| JP | 5514952 | B2 | 6/2014 |
| JP | 5514953 | B2 | 8/2014 |
| KR | 10-0904333 | A | 6/2009 |
| TW | 201016148 | A1 | 5/2010 |
| TW | 201240613 | A1 | 10/2012 |
| TW | 201240614 | A1 | 10/2012 |
| WO | WO 97/02759 | A1 | 1/1997 |
| WO | WO 2006/023281 | A2 | 3/2006 |
| WO | WO 2009/142159 | A1 | 11/2009 |
| WO | WO 2009/157240 | A1 | 12/2009 |

OTHER PUBLICATIONS

Malaysia Office Action mailed Nov. 30, 2015 in Application No. PI 2013701423.
Korean Office Action for Korean Application No. 10-2013-7023185 dated Oct. 31, 2014 with English translation.
International Search Report, issued in PCT/JP2012/054828, dated Jun. 12, 2012.
PCT/ISA/237—mailed on Jun. 12, 2012, issued in PCT/JP 2012/054828.
China Office Action for No. 201280019134.7 dated Jun. 1, 2015.
China Office Action for No. 201280019148.9 dated Jun. 11, 2015.
Chinese Office Action and Search Report, dated Jul. 3, 2015, for Chinese Application No. 201280019136.6, with an English translation thereof.
AGARGEL XP-002727227, from internet on Jul. 28, 2014, pp. 1-2.
Kochumalayil et al., Tamarind seed xyloglucan—a thermostable high-performance biopolymer from non-food feedstock XP 002727189 Journal of Materials Chemistry, vol. 20, Apr. 27, 2010, pp. 4321-4327.
Miyoshi et al. "Rheological and thermal studies of gel-sol transition in gellan gum aqueous solutions" XP-002727190 Carbohydrate Polymers, vol. 30, 1996, pp. 109-119.
Nishinari et al., XP-002727188 "Rheological and related study of gelation of xyloglucan in the presence of small molecules and other polysaccharides" Cellulose August, vol. 13, No. 4, Aug. 2006, pp. 365-374.
Nitta et al., "Synergistic Gel Formation of Xyloglucan/Gellan Mixtures as Studied by Rheology, DSC, and Circular Dichroism" XP-002727187 Biomacromolecules, vol. 4., No. 6, Nov. 2003, pp, 1654-1660.
Nitta et al., XP055097026 "Gelation and gel properties of polysaccharides gellan gum and tamarind xyloglucan", Journal of biological macromolecules, Nov. 1, 2005, pp. 47-52.
International Preliminary Report on Patentability for PCT/JP2012/054828 dated Sep. 3, 2013.
International Preliminary Report on Patentability for PCT/JP2012/054826 dated Sep. 3, 2013.
International Preliminary Report on Patentability for PCT/JP2012/054827 dated Sep. 3, 2013.
Korean Office Action for Application No. 10-2013-7023164 dated Oct. 28, 2014 with English Translation.
Taiwanese Office Action for Taiwanese Application No. 10106671 dated Oct. 28, 2014 with English Translation.
Taiwanese Office Action for Taiwanese Application No. 101106668 dated Oct. 28, 2014 with English Translation.
Chinese Office Action, dated Mar. 4, 2016, for Chinese Application No. 201280019136.6 , along with an English translation.
Chinese Office Action dated Jan. 11, 2016, for Chinese Application No. 201280019134.7 with the English translation.
Office Action in co-pending U.S. Appl. No. 13/963,821 dated Feb. 19, 2016.
Chinese Office Action for Chinese Application No. 201280019148.9, dated Feb. 16, 2016, with an English translation.
CPKelco, GENU Carrageenan Book XP-002727226 dated Jan. 1, 2002.
EP Extended Search Report dated Sep. 8, 2014 for PCT/JP2012054826.
European Office Action, dated Jun. 16, 2016, for European Application No. 12 751 885.0.
European Office Action, dated Jun. 16, 2016, for European Application No. 12 752 507.9.
European Office Action, dated Jun. 16, 2016, for European Application No. 12 752 746.3.
China Light Industry Press, "Food Thickener" 2nd editition, Jan. 2009.
Chinese Office Action for corresponding Application No. 201280019134.7 mailed Jul. 19, 2016.
Non-Final Office Action in co-pending U.S. Appl. No. 13/963,499 issued on Aug. 11, 2016.
Notice of Allowance in co-pending U.S. Appl. No. 13/963,653 dated Aug. 17, 2016.

* cited by examiner

METHOD FOR PREPARING FLAVOR-CONTAINING SHEET FOR SMOKING ARTICLE, FLAVOR-CONTAINING SHEET FOR SMOKING ARTICLE PREPARED BY THE METHOD, AND SMOKING ARTICLE COMPRISING THE SAME

CROSS REFERENCE TO RELATED APPLICATIONS

This application is a Continuation Application of PCT Application No. PCT/JP2012/054828, filed Feb. 27, 2012 and published as WO 2012/118034 Al on Sep. 7, 2012, which claims the benefit of priority from prior Japanese Patent Application No. 2011-045290, filed Mar. 2, 2011, the entire contents of all of which are incorporated herein by reference.

BACKGROUND OF THE INVENTION

1. Field of the Invention

The present invention relates to a method for preparing a flavor-containing sheet used for a smoking article, a flavor-containing sheet for a smoking article prepared by the method, and a smoking article comprising the same.

2. Description of the Related Art

If a volatile flavor component such as menthol is added to cut tobacco in a solution state, the flavor component is dissipated in a long-term storage and the flavor effect does not last. In order to solve such a problem, various reports have been made.

Patent Documents 1 and 2 disclose that a flavor component is placed in the filter part of a cigarette with the flavor component coated with a natural polysaccharide to suppress the volatilization and dissipation of the flavor component; and the coated favor component is crushed by pressing it to release the flavor at the time of smoking. Patent Document 3 discloses that a flavor component is placed in the filter part of a cigarette with the flavor component coated with a water-soluble matrix such as dextrin to suppress the volatilization and dissipation of the flavor component; and the water-soluble matrix is dissolved by the moisture in the mainstream smoke to release the flavor at the time of smoking. Thus, when the flavor component is placed in the filter part which is a non-burning part of the cigarette, there is a time lag until the flavor is tasted because the flavor is released by pressing the filter part at the time of smoking or dissolving the water-soluble matrix by the moisture in the mainstream smoke.

On the other hand, Patent Documents 4 to 6 report an example in which a flavor component is placed in a burning part, that is, cut tobacco or a cigarette paper which wraps it.

Patent Document 4 discloses that a cigarette paper which wraps tobacco filler is coated with a flavor material in which the flavor component is incorporated into the three-dimensional network of the glucan molecules. The cigarette of Patent Document 4 has a good flavor-retaining property since the flavor component is fixed and retained with incorporated into the three-dimensional network of the glucan molecules. However, the flavor component is present in the glucan molecules in a relatively small amount (20 wt % or less). Accordingly, in the case of the flavor component which requires a relatively large amount to be added, such as menthol, the blending amount of the flavor material to the cigarette becomes high.

Patent Document 5 discloses that "a stabilized flavor substance which is stable up to 180° C." is prepared by mixing a liquid flavor with a carrageenan sol; dropping the mixture into an ionic solution (a solution containing potassium ions) to prepare a particulate gel; and drying the gel in the air. However, the method of Patent Document 5 requires long periods of time and large facilities in order to prepare a large amount of the material because the granular gel is dried in the air. In addition, the method requires the addition of a metal ion (gelling accelerator) in order to form a gel.

Patent Document 6 reports that a sheet containing a flavor component with coated with a gel of polysaccharide is produced by drying a slurry containing the flavor component such as menthol and the polysaccharide; and the sheet is cut and the cut pieces is added to cut tobacco. According to the report, it takes a week to dry the slurry at 40° C.

As described above, various reports have been made as technique for suppressing the volatilization of the flavor component, but there is still a need for a easy method of preparing a flavor material having a further improved flavor-retaining property after storage.

PRIOR ART DOCUMENT

Patent Document

Patent Document 1: Jpn. Pat. Appln. KOKAI Publication No. 64-27461

Patent Document 2: Jpn. Pat. Appln. KOKAI Publication No. 4-75578

Patent Document 3: International Publication No. 2009-157240

Patent Document 4: Jpn. Pat. Appln. KOKAI Publication No. 9-28366

Patent Document 5: Jpn. PCT National Publication No. 11-509566

Patent Document 6: International Publication No. 2009-142159

BRIEF SUMMARY OF THE INVENTION

Problem to be Solved by the Invention

An object of the present invention is to provide a method for preparing a flavor-containing sheet for a smoking article in a shorter time wherein the sheet has a high flavor content, a high flavor yield, and a high post-storage flavor-retaining property when incorporated into the smoking article. Further, an object of the present invention is to provide a flavor-containing sheet for a smoking article which has a high post-storage flavor-retaining property when incorporated into the smoking article and can be prepared in a shorter time.

Means for Solving the Problem

The present inventors have examined in order to solve the problems. As a result, they have found that it is possible to prepare a flavor-containing sheet which has a high flavor content and a high flavor yield and maintains the high flavor content even after storage, by using gellan gum and tamarind gum in combination as polysaccharide and cooling the sheet once before heat-drying and then drying it, in the preparation of a flavor-containing sheet by heat-drying a raw material slurry containing polysaccharide, a flavor and an emulsifier. Further, they have found that when gellan gum and tamarind gum are used in combination as polysaccharide, the emulsion stability of the raw material slurry can be improved. Thus, they have completed the present invention.

That is, according to an aspect of the present invention, there is provided a method for preparing a flavor-containing sheet for a smoking article, characterized by comprising: a step of extending a raw material slurry on a substrate, wherein the slurry contains polysaccharide consisting of gellan gum and tamarind gum, a flavor, an emulsifier and 70 to 95 wt % of water, has a weight ratio of gellan gum to tamarind gum of 1:1 to 3:1, and has a temperature of 60 to 90° C. in a sol state; a step of cooling the extended raw material slurry to a sample temperature of 0 to 40° C. to form a gel; and a heat-drying step comprising heating the gelled raw material and drying it at a sample temperature of 70 to 100° C.

According to a preferred embodiment, the emulsifier is lecithin. Alternatively, according to a preferred embodiment, the emulsifier is an ester selected from the group consisting of glycerin fatty acid ester, polyglycerin fatty acid ester, sorbitan fatty acid ester, polyoxyethylene sorbitan fatty acid ester, propylene glycol fatty acid ester, and sucrose fatty acid ester.

According to another aspect of the present invention, there is provided a flavor-containing sheet for a smoking article, characterized in that it is prepared by the above-mentioned method.

According to another aspect of the present invention, there is provided a smoking article comprising cut tobacco, characterized in that cut pieces of the above-mentioned flavor-containing sheet for a smoking article are blended with the cut tobacco.

Effects of the Invention

According to the method for preparing a flavor-containing sheet for a smoking article of the present invention, it is possible to prepare a flavor-containing sheet for a smoking article in a shorter time wherein the sheet has a high flavor content, a high flavor yield, and a high post-storage flavor-retaining property when incorporated into the smoking article. Further, the flavor-containing sheet for a smoking article of the present invention has a high post-storage flavor-retaining property when incorporated into the cigarette and can be prepared in a shorter time.

DETAILED DESCRIPTION OF THE INVENTION

Figure 1:
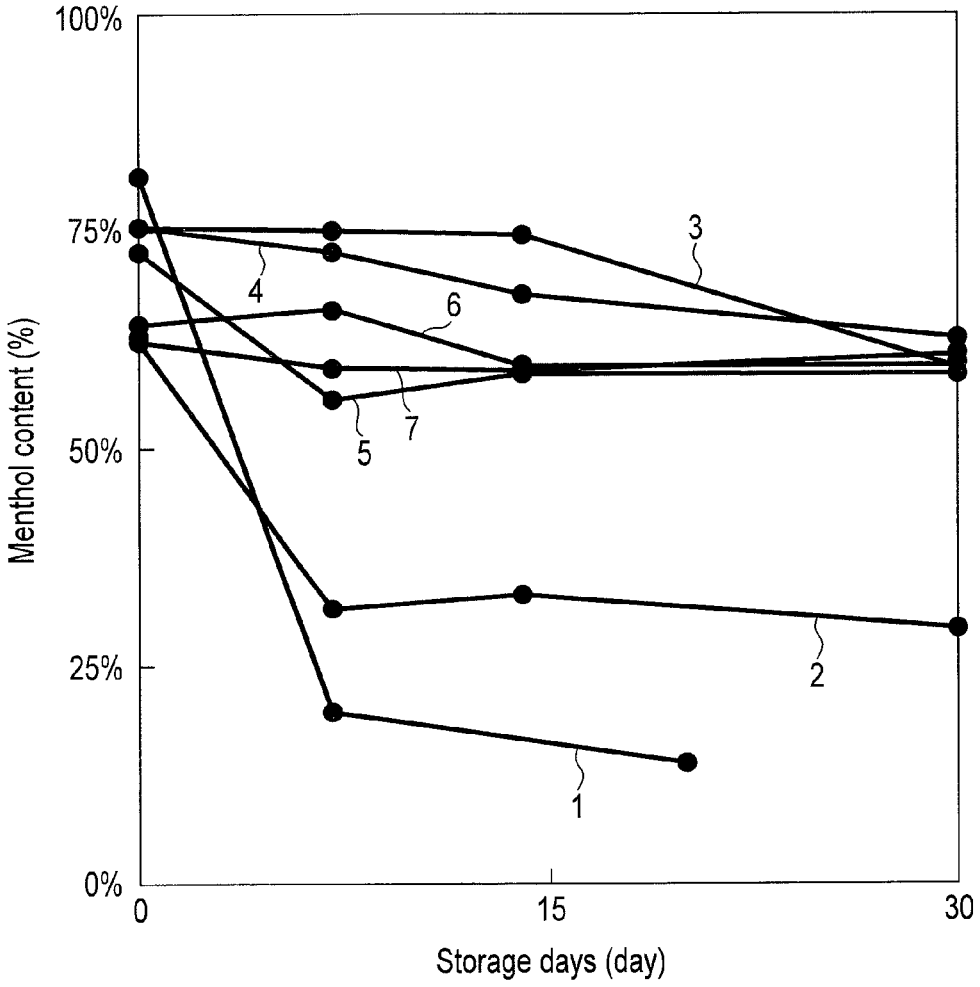
FIG. 1 is a graph showing the menthol content of menthol-containing sheets after storage periods.

The present invention will be explained below. The following explanations are intended to describe the present invention in detail, and are not intended to limit the present invention.

A flavor contained in the flavor-containing sheet of the present invention is not limited as long as it is used for a smoking article. Any type of flavor can be used. Main examples of the flavor include menthol, leaf tobacco extract; natural plant flavors (e.g., cinnamon, sage, herb, chamomile, kudzu (Pueraria lobata), hydrangeae dulcis folium, clove, lavender, cardamom, caryophyllus, nutmeg, bergamot, geranium, honey essence, rose oil, lemon, orange, cassia bark, caraway, jasmine, ginger, coriander, vanilla extract, spearmint, peppermint, cassia, coffee, celery, cascarilla, sandalwood, cocoa, ylang ylang, fennel, anise, licorice, St John's bread, prune extract, and peach extract); saccharides (e.g., glucose, fructose, isomerized saccharide, and caramel); cocoa (e.g., powder and extract); esters (e.g., isoamyl acetate, linalyl acetate, isoamyl propionate, and linalyl butyrate); ketones (e.g., menthone, ionone, damascenone, and ethyl maltol); alcohols (e.g., geraniol, linalool, anethole, and eugenol); aldehydes (e.g., vanillin, benzaldehyde, and anisaldehyde); lactones (e.g., γ-undecalactone and γ-nonalactone); animal flavors (e.g., musk, ambergris, civet, and castoreum); and hydrocarbons (e.g., limonene and pinene). A flavor which easily forms a dispersion state in a solvent by addition of an emulsifier, such as a hydrophobic flavor and oil-soluble flavor may be preferably used. Such a flavor may be used alone or in combination.

Hereinafter, the present invention will be explained with an example where menthol is used as a flavor.

1. Menthol-Containing Sheet for Smoking Article

In an embodiment of the present invention, a menthol-containing sheet for a smoking article (hereinafter referred to as "menthol-containing sheet") is prepared by the method comprising:

a step of extending a raw material slurry on a substrate, wherein the slurry contains polysaccharide consisting of gellan gum and tamarind gum, a flavor, an emulsifier and 70 to 95 wt % of water, has a weight ratio of gellan gum to tamarind gum of 1:1 to 3:1, and has a temperature of 60 to 90° C. in a sol state;

a step of cooling the extended raw material slurry to a sample temperature of 0 to 40° C. to form a gel; and a heat-drying step comprising heating the gelled raw material and drying it at a sample temperature of 70 to 100° C.

The term "sample temperature" used herein means a temperature on the surface of a sample (i.e., a slurry or a sheet).

(1) Preparation of Raw Material Slurry

In the present invention, the raw material slurry can be prepared by a method comprising: (i) a step of mixing polysaccharide consisting of a mixture of gellan gum and tamarind gum and having a weight ratio of gellan gum to tamarind gum of 1:1 to 3:1 with water and heating the mixture to prepare an aqueous solution of the polysaccharide; and (ii) a step of adding menthol and an emulsifier to the aqueous solution and kneading and emulsifying the mixture.

Specifically, the step (i) can be performed by adding polysaccharide to water in small amounts to dissolve it in water while stirring. The heating temperature in the step may be from 60 to 90° C., preferably from 75 to 85° C. The step (ii) can be performed by any known emulsification techniques using a homogenizer since the raw material slurry has a viscosity of about 10,000 mPas (sol state), which does not interfere with the emulsification, at the above heating temperature.

Polysaccharide (i.e., a mixture of gellan gum and tamarind gum) is preferably contained in the raw material slurry at a concentration of 2 to 7 wt %. For example, when 10 L of water is used as a solvent for the raw material slurry, the raw material slurry may contain 200 to 700 g of polysaccharide. More preferably, polysaccharide is contained in the raw material slurry at a concentration of 3 to 5 wt % (see Example 13 below).

The composition of the raw material slurry can be as follows: for example, 500 g of polysaccharide, 500 to 5000 g of menthol, and 50 to 500 mL of a solution containing 5 wt % of an emulsifier, per 10 L of water. Here, the polysaccharide is consisted of 250 to 375 g of gellan gum and 125 to 250 g of tamarind gum so that the total weight of gellan gum and tamarind gum is 500 g.

The moisture content of the raw material slurry is from 70 to 95 wt %, preferably from 80 to 90 wt %.

The ratio (weight ratio) of polysaccharide and menthol in the raw material slurry may be in a range of 1:1 to 1:5, preferably 1:2.5 to 1:5. That is, the blending amount of menthol may be in a range of 100 to 500 wt % base on the polysaccharide, preferably 250 to 500 wt % based on the polysaccharide (see Example 14 below).

The polysaccharide in the raw material slurry is consisted of gellan gum and tamarind gum, and the weight ratio of gellan gum and tamarind gum is from 1:1 to 3:1 (see Example 9 below). That is, the polysaccharide in the raw material slurry is consisted of gellan gum and tamarind gum and contains gellan gum at a weight ratio of 50 to 75%.

In the present invention, the polysaccharide has a property of fixing micelle of menthol to coat it, by forming gel when cooling once after heating. Regarding the polysaccharide consisting of gellan gum and tamarind gum, it is found that the aqueous solution of the polysaccharide exhibits especially excellent sol-gel transition characteristics in response to temperature (see Example 13 below). That is, once the aqueous solution containing gellan gum and tamarind gum is cooled and forms gel, the solution has characteristics of being capable of maintaining the gel state without easily returning to a sol state even if the temperature is raised afterward (see FIG. 11B). Even if the menthol coated with the polysaccharide consisting of gellan gum and tamarind gum is once cooled and then exposed to high temperatures in the heat-drying step, the coat is hard to return to the sol state due to the characteristics, and the menthol in the coat can be stably maintained (see Sample Nos. 4 to 7 of FIG. 1, and FIG. 11C). The characteristics are referred to as "temperature-responsive sol-gel transition characteristics" in the present invention.

Thus, the polysaccharide having temperature-responsive sol-gel transition characteristics has advantages in that high post-storage flavor retaining properties can be achieved by coating menthol with it, and also in that it is not necessary to add metal ions (a gelation accelerator), if the temperature-responsive sol-gel transition characteristics are used for gelation.

In the present invention, 1-menthol may be used as menthol.

In the present invention, a naturally occurring emulsifier such as lecithin, specifically, SUN LECITHIN A-1 (Taiyo Kagaku Co., Ltd.), may be used as the emulsifier.

When lecithin is used as the emulsifier, lecithin may be contained in the slurry in an amount of 1 to 10 wt % based on the polysaccharide. Preferably, lecithin may be contained in an amount of 1 to 5 wt % based on the polysaccharide (see Example 10 below).

As the emulsifier, esters selected from the group consisting of glycerin fatty acid ester, polyglycerin fatty acid ester, sorbitan fatty acid ester, polyoxyethylene sorbitan fatty acid ester, propylene glycol fatty acid ester, and sucrose fatty acid ester may be used in addition to lecithin.

Glycerin fatty acid ester includes, for example, fatty acid monoglycerides such as monoglyceride monostearate or monoglyceride succinate; polyglycerin tatty acid ester includes, for example, pentaglycerin monostearate; sorbitan fatty acid ester includes, for example, sorbitan monostearate; polyoxyethylene sorbitan fatty acid ester includes, for example, polyoxyethylene sorbitan monostearate; propylene glycol fatty acid ester includes, for example, propylene glycol monostearate; and sucrose fatty acid ester includes, for example, sucrose stearic acid ester (see Example 12 below). These emulsifiers may be also contained in the slurry in an amount of 1 to 10 wt % based on the polysaccharide, preferably 1 to 5 wt % based on the polysaccharide.

These emulsifiers have a function of emulsifying and dispersing the micell of menthol coated with the polysaccharide, in water. When only gellan gum is used as the polysaccharide and a high concentration of lecithin is added to the raw material as the emulsifier, a stable emulsified state of the raw material cannot be formed. On the other hand, when gellan gum and tamarind gum are used in combination as the polysaccharide, the emulsified state of the raw material can be kept stable even if the blending amount of lecithin is high. This is newly found by the present invention (see Example 10 below). Further, when the raw material slurry containing only gellan gum as the polysaccharide is left to stand after the preparation, the emulsified state of the raw material becomes slightly unstable. On the other hand, when the raw material slurry containing gellan gum and tamarind gum as the polysaccharide is left to stand after the preparation, the emulsified state of the raw material can be kept stable. This is newly found by the present invention (see Example 11 below).

Thus, the raw material slurry containing gellan gum and tamarind gum has a property to stably maintain the emulsified state of the raw material (i.e., emulsion stability). Accordingly, the emulsion stability enables the menthol content of the prepared sheet to be stably maintained after storage.

(2) Extension of Raw Material Slurry on Substrate

The prepared raw material slurry having a temperature of 60 to 90° C. is extended on a substrate.

The raw material slurry can be extended by extruding the raw material slurry on the substrate with a casting gate or through a slit die. As the substrate, any type of substrate may be used, as long as the menthol-containing sheet prepared by dry-forming can be peeled off from the substrate. For example, a polyethylene terephthalate (PET) film (FE2001, FUTAMURA CHEMICAL CO., LTD.) may be used. The raw material slurry can be extended so that the thickness after drying becomes about 0.1 mm, which is equal to the thickness of normal cut tobacco.

(3) Cooling before dry-forming of slurry

In the preparation of the menthol-containing sheet of the present invention, the extended raw material slurry is once cooled before drying so that the slurry becomes a temperature enabling sufficient gelation of the slurry (40° C. or less) and avoiding breaking of emulsion due to freezing (0° C. or more), i.e., a temperature of 0 to 40° C., preferably 0 to 30° C., and more preferably 15 to 25° C. The raw material slurry before cooling has a temperature of 60 to 90° C., preferably a temperature of 75 to 85° C., and is in a sol state. The preliminary cooling may be performed by blowing the air or the cold air (e.g., 10° C.) generated by a spot cooler (e.g., Suiden SS-25DD-1) on the extended raw material slurry for 2 to 3 minutes. Alternatively, the preliminary cooling may be performed by contacting the extended raw material slurry with a tube through which the cooling medium (e.g., 10° C.) generated by a chilled water generator (a chiller, for example, APISTE PCU-1600R) is running, for 1 to 2 minutes. Alternatively, the preliminary cooling may be performed by allowing the extended raw material slurry to stand at room temperature.

As shown in Example 4 below, once a solution of the polysaccharide listed above is cooled and forms gel, the solution has a property of being capable of maintaining the gel state without easily returning to a sol state even at the gel transition temperature even if the temperature is raised afterward. The above property is utilized in the present invention, and the preliminary cooling is performed before drying the raw material slurry. As a result, the polysaccharide contained in the raw material slurry after the preliminary cooling is hard to solate even if the temperature is raised at the time of drying, and the menthol coated with the polysaccharide is hard to volatilize. This is demonstrated in the present invention.

When the raw material slurry is extended on the substrate and cooled once, it is advantageous in that the extended raw material slurry is hard to deform even if it is exposed to high temperatures in the subsequent drying step.

Figure 4A:
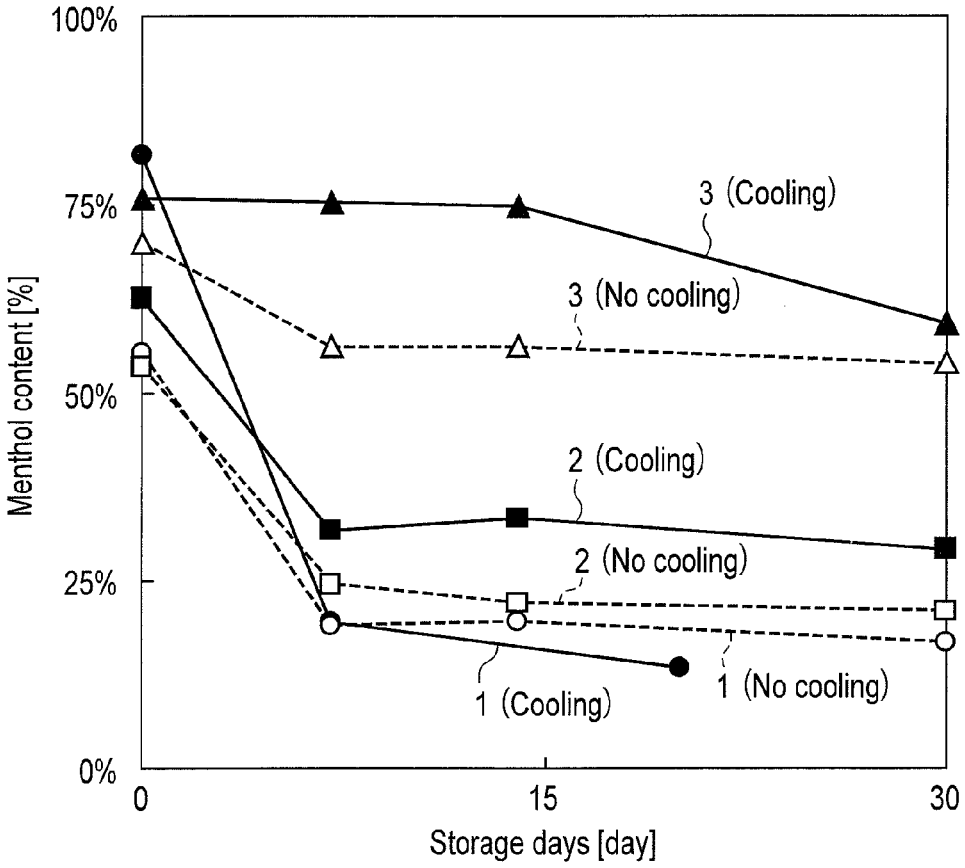
FIG. 4A is a graph showing cooling effects on the post-storage menthol content of the menthol-containing sheets (comparative examples).
Figure 4B:
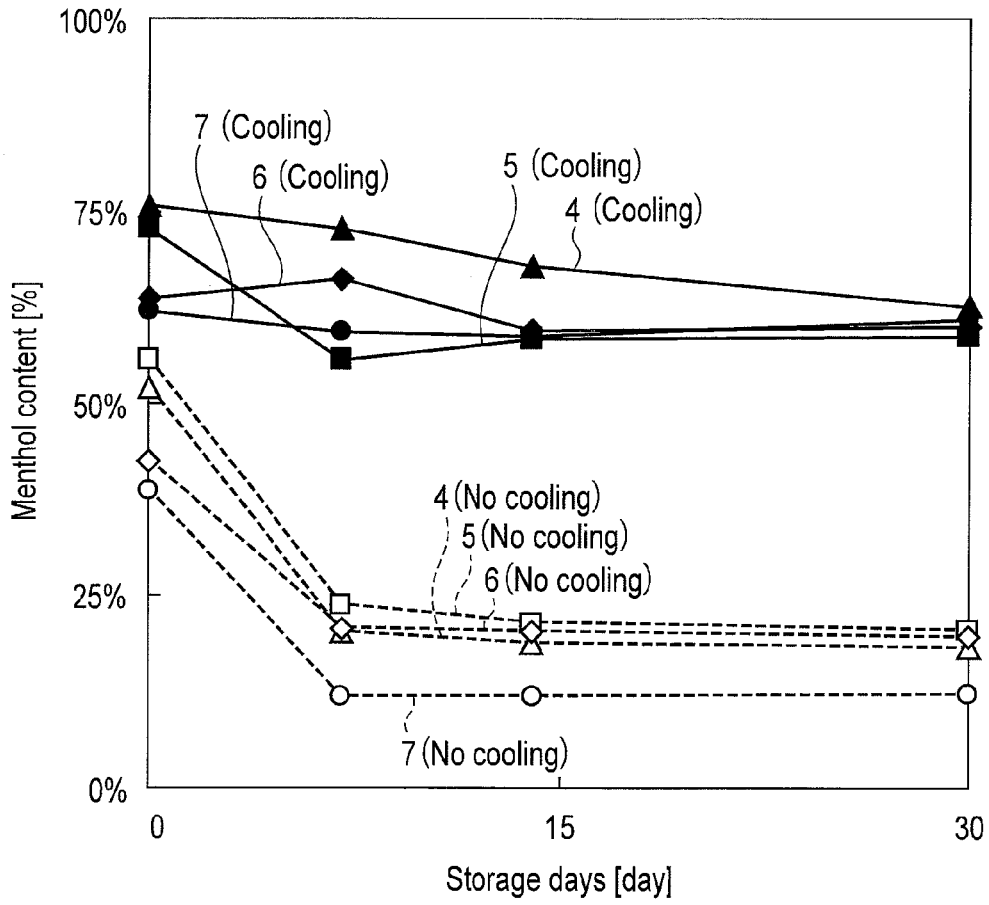
FIG. 4B is a graph showing cooling effects on the post-storage menthol content of the menthol-containing sheets (examples of the present invention).
Figure 5:
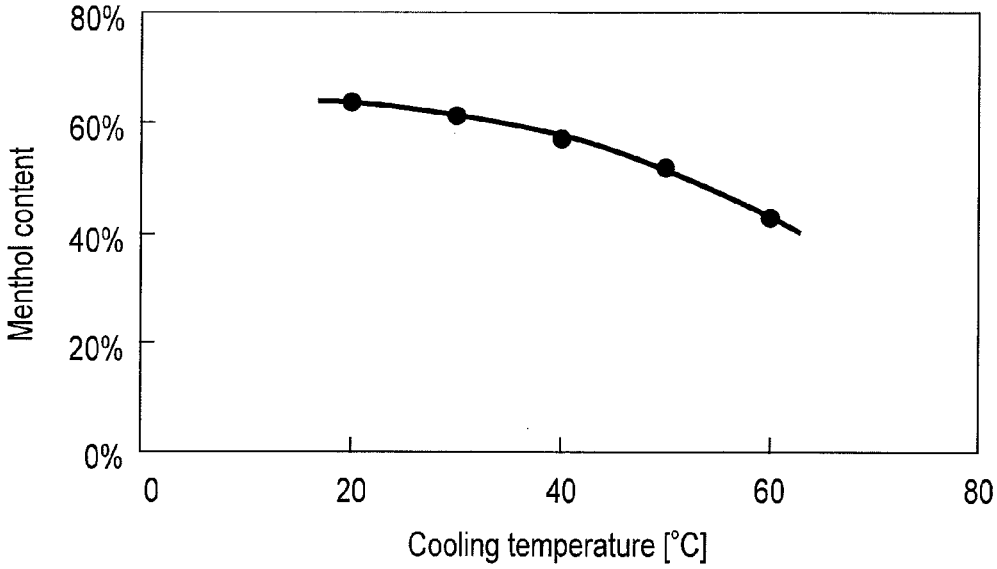
FIG. 5 is a graph showing a relationship between the cooling temperature and the menthol content of the menthol-containing sheets.

The cooling effect on the post-storage flavor-retaining property of the flavor-containing sheet (e.g., menthol-containing sheet) is demonstrated in Example 6 below (FIG. 4B). Lower cooling temperatures result in larger contents of menthol, which is demonstrated in Example 7 below (FIG. 5).

(4) Dry Forming of Slurry

The heat-drying of the extended and cooled raw material slurry can be performed by any type of heat-drying means such as a hot air drying or an infrared heat drying. Hereinafter, the "heat-drying" of the raw material slurry is simply referred to as "drying".

In the present invention, the drying of the raw material slurry includes drying by heating the cooled raw material slurry at a sample temperature of 70 to 100° C. Preferably, the sample temperature is 100° C. or less over the total drying time. If the slurry is dried at the above-mentioned sample temperature, the volatilization of menthol can be suppressed, and a menthol-containing sheet can be prepared in a shorter time.

The term "sample temperature" means a temperature on the surface of a sample (i.e., a slurry or a sheet). The term "total drying time" means a period to be heated in a heat-dryer. The total drying time is generally 20 minutes or less, preferably from 7 to 20 minutes, more preferably from 10 to 18 minutes.

In the present invention, the sample temperature may be less than 70° C. during the drying step. However, in order to shorten the drying time, it is preferable to short the period when the sample temperature is less than 70° C. In present invention, the sample temperature may exceed 100° C. during the drying step. However, in order to stably maintain menthol, it is preferable to short the period when the sample temperature exceeds 100° C. Therefore, the drying of the raw material slurry can be preferably performed by drying the cooled raw material slurry at a sample temperature of 70 to 100° C. for more than one-half of the total drying time. Preferably, the sample temperature is 100° C. or less over the total drying time. More preferably, the drying of the raw material slurry can be performed by drying the cooled raw material slurry at a sample temperature of 70 to 100° C. over the total drying time.

However, immediately after the heat-drying is started, the temperature of the sample in the heat-dryer is in the middle of increasing from the preliminary cooling temperature to a desired sample temperature (70° C.) and does not reach the desired sample temperature. When expressed as "at a sample temperature of 70 to 100° C. over the total drying time", the term "total drying time" means a total drying time excluding the beginning period when the sample temperature is in the middle of increasing to the desired sample temperature. For example, in Example 5 (FIGS. 3A to 3G) below, the sample temperature is in the middle of increasing to the desired sample temperature for about 1 minute after the start of heat-drying. Thus, the beginning period is excluded from the "total drying time", when expressed as "at a sample temperature of 70 to 100° C. over the total drying time".

Preferably, the drying of the raw material slurry can be performed by drying the raw material slurry so that a sheet form having a moisture content of less than 10% is prepared for a total drying time of 20 minutes or less.

In Example 5 below (FIGS. 3D to 3G), it is demonstrated that when the raw material slurry is dried at the above sample temperature, the sheet obtained by the drying can achieve a high post-storage flavor-retaining property.

Hereinafter, the case of hot air drying will be explained. In the case of hot air drying, in order to maintain a sample temperature of 70 to 100° C., the raw material slurry is preferably dried with hot air having a temperature of 100° C. or more at the time of initial drying, and then, with hot air having the same temperature as the initial drying or a temperature lower than the initial drying (preferably 70° C. or more and less than 100° C.). Accordingly, it is possible to suppress the sample temperature rise in the latter drying. For example, it is possible to keep the sample temperature so as not to exceed 100° C. over the total drying time.

In the present invention, it is possible that the prepared menthol-containing sheet has a high menthol content and a high yield of menthol, and maintains a high menthol content after storage, once the raw material slurry is cooled even if the subsequent drying step includes a drying process in which the sample temperature reaches 70 to 100° C. (e.g., high temperature drying with hot air having a temperature of 100° C. or more).

In the case of hot air drying, the hot air temperature may be a constant temperature in the whole period of the drying step or may be changed in the period of the drying step. When the hot air temperature is changed, the drying of the raw material slurry is preferably performed by the initial drying at a high temperature with hot air having a temperature of 100° C. or more and the latter drying at a low temperature with hot air having a temperature of less than 100° C. The term "initial drying" used herein means the first drying in the drying step with hot air having a temperature of 100° C. or more, and the term "latter drying" means the drying followed by the initial drying, with hot air having a low temperature of less than 100° C. Thus, if the initial drying with hot air having a high temperature is performed in combination with the latter drying with hot air having a low temperature, it is advantageous in that the sample temperature does not become too high. In the case of hot air drying, the temperature in the dryer is the same as the hot air temperature.

More preferably, the raw material slurry can be dried so that a sheet form having a moisture content of less than 10% is prepared for a total drying time of 20 minutes or less, by performing the initial drying at a hot air temperature of 100° C. or more for a quarter or more of the total drying time and then the latter drying at a hot air temperature of less than 100° C. for a quarter or more of the total drying time.

Thus, if the initial drying with hot air having a high temperature is performed in combination with the latter drying with hot air having a low temperature, it is possible to suppress the sample temperature rise in the latter drying. For example, it is possible to keep the sample temperature so as not to exceed 100° C. Accordingly, it is possible that the menthol-containing sheet of the present invention has a high menthol content after the sheet preparation and also maintains a high menthol content after storage (see Sample No. 4 of Example 1, Sample No. 5 of Example 2, and Sample No. 6 of Example 3 below).

When the raw material slurry is dried by hot air drying, the initial drying can be performed, for example, with hot air having a temperature of 100 to 130° C. for 4 to 6 minutes, and the latter drying can be performed, for example, with hot air having a temperature of 70° C. or more and less than 100° C. for 4 to 6 minutes. The air volume of hot air may be set to, for example, 3 to 20 m/sec. The total drying time is generally 20 minutes or less, preferably from 7 to 20 minutes, more preferably from 10 to 18 minutes.

The conditions of the initial drying and the latter drying (temperature, time, and air volume) can be appropriately set, for example, within the above range. For example, the initial drying is performed at a hot air temperature of 100 to 130° C. until the moisture of the surface of the raw material slurry is evaporated and a film is sufficiently formed on the surface of the slurry. Thereafter, the hot air temperature is immediately changed to a range of 70° C. or more and less than 100° C., and the latter drying can be performed.

The hot air temperature during the initial drying may be constant, or may be changed so as to sequentially decrease within a range of 100 to 130° C. The hot air temperature during the latter drying may be constant, or may be changed so as to sequentially decrease within a range of 70° C. or more and less than 100° C. For example, the hot air drying machine used in Examples below has three drying chambers and each sample is conveyed in the order of the first, second, and third chambers by a belt conveyor. Thus, the first and second chambers may be used for the initial drying at the same or different temperatures (100° C. or more) and the third chamber may be used for the latter drying (less than 100° C.). Alternatively, the first chamber is used for the initial drying (100° C. or more) and the second and third chambers may be used for the latter drying at the same or different temperatures (less than 100° C.)

In the present invention, the drying is performed until the menthol-containing sheet is sufficiently dried so that the sheet can be easily peeled off from a substrate and can be cut in the subsequent cutting step. Specifically, the drying is performed until the moisture content of the menthol-containing sheet reaches less than 10 wt %, preferably from 3 to 9 wt %, more preferably from 3 to 6 wt % (see Example 8 below). The term "moisture content" used herein means a value measured according to the measurement method described in the following examples.

Immediately after the preparation, the menthol content of the menthol-containing sheet of the present invention is preferably 45 wt % or more, more preferably from 55 to 75 wt %. After storage (at 50° C. for 30 days), the menthol content of the menthol-containing sheet of the present invention is preferably 45 wt % or more, more preferably from 48 to 63 wt %. The term "menthol content" used herein means a value measured according to the measurement method described in the following examples.

2. Smoking Article

The menthol-containing sheet of the present invention is cut into, for example, a size equal to that of normal cut tobacco, and thus the cut pieces can be blended with cut tobacco for the smoking article. The cut pieces of the menthol-containing sheet can be added in an amount of 2 to 10 g per 100 g of cut tobacco. The cut pieces of the menthol-containing sheet is preferably dispersed in the cut tobacco and blended with it.

The menthol-containing sheet of the present invention can be blended with cut tobacco of any type of smoking articles, for example, a burning type smoking article in which a smoker tastes the flavor of smoke by burning the tobacco leaves, particularly a cigarette. Particularly, the menthol-containing sheet of the present invention can be blended with cut tobacco of a cigarette comprising a cigarette rod which includes cut tobacco and a cigarette paper wrapped around the cut tobacco.

EXAMPLES

Example 1

(1) Preparation of Raw Material Slurry (10 L Scale)

Water 10 L

Gellan gum (KELCOGEL, San-Ei Gen F.F.I., Inc.) 150 g

Tamarind gum (BISTOP D-2032, San-Ei Gen F.F.I., Inc.) 150 g

Lecithin (SUN LECITHIN A-1, Taiyo Kagaku Co., Ltd.) 120 mL (5% aqueous solution)

Menthol (Takasago International Corporation.) 1500 g

Water (10 L) was kept at 80° C., and gellan gum (150 g) and tamarind gum (150 g) were added and dissolved therein in small portions so as not to form lumps (the time required: about 20 minutes), while stirring them with a mixer (PRIMIX T.K. AUTO MIXER Model 40/equipped with a rotor for stirring a solution/2000 rpm), and menthol (1500 g) was added.

The stirring mixer was replaced with a homogenizer (PRIMIX T.K. AUTO MIXER Model 40/equipped with a rotor-stator head/4000 rpm) and the mixture was emulsified for 10 minutes. Then, lecithin (120 mL of 5% aqueous solution) was added thereto, followed by emulsification for 10 minutes to prepare a raw material slurry.

(2) Dry Forming

The obtained raw material slurry was extruded on a base film through a slit die. After that, the cold air generated by a spot cooler (Suiden SS-25DD-1) (10° C.) was blown on the raw material slurry for 2 to 3 minutes so that the raw material slurry was cooled to about 20° C. After that, it was dried with hot air by carrying it on the belt conveyor in the hot-air drying machine to obtain a menthol-containing sheet in film form. The details of the experiment will be described below.

Slit die: vertical slit die (which was heated at 60° C. and kept warm), 900 μm in thickness and 20 cm in width Base film: PET film (which was surface corona treated), 50 μm in thickness Hot air drying machine: hot air type of a dry forming machine having the following configuration Drying compartment: three chambers (each zone length: 2.5 m, total length: 7.5 m)

Air volume and form of hot air:

First chamber: perforated plate, air volume: 5 m/sec.

Second chamber: perforated plate, air volume: 10 m/sec.

Third chamber: floating jet, air volume: 20 m/sec.

In the first and second chambers, hot air was blown on the menthol-containing sheet which was conveyed on the belt, through a perforated plate which functions as a flow control plate. In the third chamber, hot air was blown on the menthol-containing sheet which was conveyed while floating together with a base film by upward and downward ventilation.

The hot air drying conditions were changed as described in Table 1 below to prepare menthol-containing sheets of Sample Nos. 1 to 4. The temperature described in the table are hot air temperature. The drying time was set so that the menthol-containing sheet was sufficiently dried, can be easily peeled off from the base film, and can be cut in the subsequent cutting step. The moisture content of the menthol-containing sheets obtained in this example was about 3%.

(3) Measurement of Dry State of Menthol-Containing Sheet

The moisture content of the menthol-containing sheet was measured by the GC-TCD as follows.

0.1 g of a menthol-containing sheet (cut into 1×10 mm pieces) was weighed. 10 mL of methanol (a new reagent of special grade or higher grade was dispensed without exposing it to the air to eliminate the influence of the water absorption in the air) was added to the cut pieces in a 50 mL closed container (screw tube), followed by shaking at 200 rpm for 40 minutes. The resulting mixture was left overnight, shaken again at 200 rpm for 40 minutes, and allowed to stand. The supernatant was used as a measurement solution (without diluting for the GC measurement).

The measurement solution was analyzed by the GC-TCD and quantified by the calibration curve method.

GC-TCD; 6890 gas chromatograph, manufactured by Hewlett Packard

Column; HP Polapack Q (packed column) Constant Flow mode 20.0 mL/min

Injection; 1.0 μL

Inlet; EPC purge packed column inlet

Heater; 230° C.

Gas; He

Total flow; 21.1 mL/min

Oven; 160° C. (hold 4.5 min)→(60° C./min)→220° C. (hold 4.0 min)

Detector; TCD detector Reference gas (He) flow rate; 20 mL/min Make up gas (He) 3.0 mL/min Signal rate; 5 Hz Concentrations of calibration curve solutions; six points of 0, 1, 3, 5, 10 and 20 [mg-H20/10 mL]

(4) Measurement of Menthol Content of Menthol-Containing Sheet

The menthol content of menthol-containing sheets was measured with GC-FID in the following manner.

0.1 g of a menthol-containing sheet (cut into 1×10 mm pieces) was weighed. 10 mL of methanol (a new reagent of special grade or higher grade was dispensed without exposing it to the air to eliminate the influence of the water absorption in the air) was added to the cut pieces in a 50 mL closed container (screw tube), followed by shaking at 200 rpm for 40 minutes. The resulting mixture was left overnight, shaken again at 200 rpm for 40 minutes, and allowed to stand. The supernatant was used as a measurement solution (by 10-fold diluting it with methanol for the GC measurement).

The measurement solution was analyzed by the GC-FID and quantified by the calibration curve method.

GC-FID; 6890N gas chromatograph, manufactured by Agilent

Column; DB-WAX 30 m×530 μm×1 μm

Constant Pressure mode 5.5 psi (velocity; 50 cm/sec)

Injection; 1.0 μL

Inlet; Spritless mode 250° C. 5.5 psi

Oven; 80° C.→(10° C./min)→170° C. (hold 6.0 min) [Max 220° C.]

Detector; FID detector 250° C. (H2; 40 mL/min air; 450 mL/min)

Signal rate; 20 Hz

Concentrations of calibration curve solutions; eight points of 0, 0.01, 0.05, 0.1, 0.3, 0.5, 0.7 and 1.0 [mg-menthol/mL]

The menthol content (mg) of the prepared menthol-containing sheet and the menthol content (mg) of the menthol-containing sheet stored in the accelerated environments were measured. The results are shown in Table 1 as the "initial menthol content (%)" and the "post-storage menthol content (%)".

Initial menthol content (%)={measured value of the menthol content (mg)/weight of the menthol-containing sheet (mg)}×100

Post-storage menthol content (%)={measured value of the menthol content (mg)/weight of the menthol-containing sheet (mg)}×100

The accelerated environments were as follows.

About 5 g of a menthol-containing sheet (cut into 1×10 mm pieces) was placed in an open container, and it was stored for a maximum of 30 days in a thermostat (Drying Oven DX600, Yamato Scientific Co., Ltd.) set at 50° C.

The menthol flavor retention rate was calculated from the value of the menthol content using the following equation, and the flavor retention ability of the menthol-containing sheet was evaluated.

Menthol flavor retention rate (%)={(post-storage menthol content)/(initial menthol content)}×100

(5) Results

The menthol-containing sheets of Sample Nos. 1 to 4 were prepared with the hot air drying machine under the hot air drying conditions described in Table 1. The moisture content and initial menthol content of the menthol-containing sheets were measured according to the above procedure. The results are shown in Table 1. The menthol content of the sheet stored for 30 days is shown in Table 1. The menthol content of the sheet stored for 7 days, 14 days and 30 days is shown in FIG. 1. The reference numerals 1 to 7 in FIG. 1 represent Sample Nos. 1 to 7.

TABLE 1

| | Sample Nos. | | | |
|---|---|---|---|---|
| | 1 | 2 | 3 | 4 |
| Hot air drying conditions | | | | |
| First chamber | 70° C. · 4 min | 120° C. · 2 min | 70° C. · 20 min | 120° C. · 2.5 min |
| Second chamber | 80° C. · 4 min | 130° C. · 2 min | 70° C. · 20 min | 120° C. · 2.5 min |
| Third chamber | 120° C. · 4 min | 176° C. · 2 min | 70° C. · 20 min | 70° C. · 2.5 min |
| Belt speed | 0.6 m/min | 1.3 m/min | 0.13 m/min | 1.0 m/min |
| Moisture content | 3.1% | 3.2% | 3.1% | 3.4% |
| Initial menthol content | 81.5% | 62.4% | 75.8% | 75.7% |
| Post-storage menthol content | 13.6% (20 days later) | 29.2% (30 days later) | 59.2% (30 days later) | 62.4% (30 days later) |
| Flavor retention rate | 17% | 47% | 78% | 82% |

Sample No. 1

When the raw material slurry is extended and dried with the hot air drying machine to form a sheet shape, in many cases, hot air drying is started at a low temperature (about 70° C.) so as not to form a surface coating in the first-half drying, and the hot air drying is continued at a high temperature (about 120° C.) so as to achieve the complete drying in the second-half drying. In accordance with this drying procedure, the menthol-containing sheet of Sample No. 1 was prepared, and as a result, a sufficiently dried sample (moisture content: 3.1%) can be prepared for a total drying time of 12 minutes. The "initial menthol content" after sheet preparation was as high as 81.5%, but the "post-storage menthol content" after stored (for 20 days) in the accelerated environments was as low as 13.6%. Thus, the sheet of Sample No. 1 had a problem in a post-storage flavor-retaining property.

Sample No. 2

In Sample No. 2, high drying temperatures were employed to make the drying time shorter than that of Sample No. 1. As a result, in Sample No. 2, a sufficiently dried sample (moisture content: 3.2%) can be prepared for a total drying time of 6 minutes. The "initial menthol content" after sheet preparation was as high as 62.4%, but the "post-storage menthol content" after stored (for 30 days) in the accelerated environments was as low as 29.2%. Thus, the sheet of Sample No. 2 had a problem in a post-storage flavor-retaining property.

Sample No. 3

In Sample No. 3, the hot air temperature was set to 70° C. in the whole period of the drying step. As a result, in Sample No. 3, a sufficiently dried sample (moisture content: 3.1%) can be prepared for a total drying time of 60 minutes. The "initial menthol content" after sheet preparation was as high as 75.8%, and the "post-storage menthol content" after stored (for 30 days) in the accelerated environments was also as high as 59.2%. Thus, both of flavor-retaining property after sheet preparation and post-storage flavor-retaining property were excellent. However, the time required for drying was as long as 60 minutes.

Sample No. 4

In Sample No. 4, in contrast to Sample Nos. 1 and 2 in which the low temperature drying was shifted to the high temperature drying, the initial drying (in the first and second chambers) was performed by hot air at a high temperature (120° C.) and the latter drying (in the third chamber) was performed by hot air at a low temperature (70° C.). In Sample No. 4, the total drying time was as short as 7.5 minutes, however a sufficiently dried sample (moisture content: 3.4%) can be prepared. The "initial menthol content" after sheet preparation was as high as 75.7%, and the "post-storage menthol content" after stored (for 30 days) in the accelerated environments was also as high as 62.4%. Thus, both of flavor-retaining property after sheet preparation and post-storage flavor-retaining property were excellent. The results show that it was possible to prepare a sheet having an excellent flavor-retaining property in a relatively short drying time, if the initial high temperature drying and the latter low temperature drying were employed.

Example 2

The menthol-containing sheet of Sample No. 5 was prepared in a similar manner to that of Example 1, except that the slurry was dried under the hot air drying conditions described in Table 2 below, and the moisture content and the menthol content were measured. The results are shown in Table 2.

TABLE 2

| | Sample No. 5 |
|---|---|
| Hot air drying conditions | |
| First chamber | 120° C. · 4 min [Floating jet 20 m/sec] |
| Second chamber | 70° C. · 4 min [Jet 20 m/sec] |
| Third chamber | 70° C. · 4 min [Jet 10 m/sec] |
| Belt speed | 0.6 m/min |
| Moisture content | 3.1% |
| Initial menthol content | 72.7% |
| Post-storage menthol content | 58.5% |
| Flavor retention rate | 80% |

In Sample No. 5, the volume of the hot air was increased as compared to those of Sample Nos. 1 to 4. In the first chamber, hot air was blown on the menthol-containing sheet which was conveyed while floating by upward and downward ventilation. In the second and third chambers, hot air was blown on the menthol-containing sheet which was conveyed on the belt by ventilation.

In Sample No. 5, the initial drying (in the first chamber) was performed by hot air at a high temperature (120° C.) for 4 minutes and the latter drying (in the second and third chambers) was performed by hot air at a low temperature (70° C.) for 8 minutes. In Sample No. 5, a sufficiently dried sample (moisture content: 3.1%) can be prepared for a total drying time of 12 minutes. The "initial menthol content" after sheet preparation was as high as 72.7%, and the "post-storage menthol content" after stored (for 30 days) in the accelerated environments was also as high as 58.5%. Thus, both of flavor-retaining property after sheet preparation and post-storage flavor-retaining property were excellent. The results show that it was possible to prepare a sheet having an excellent flavor-retaining property in a relatively short drying time, if the initial high temperature drying and the latter low temperature drying were employed.

Example 3

The menthol-containing sheets of Sample Nos. 6 and 7 were prepared in a similar manner to that of Example 1, except that the slurry was dried using a hot air drying machine having four chambers of drying compartment under the hot air drying conditions described in Table 3 below, and the moisture content and the menthol content were measured. The results are shown in Table 3.

TABLE 3

| | Sample Nos. 6 | Sample Nos. 7 |
|---|---|---|
| Hot air drying conditions | | |
| First chamber | 110° C. · 2.2 min [Jet 10 m/sec] | 100° C. · 2.2 min [Jet 10 m/sec] |
| Second chamber | 100° C. · 2.2 min [Jet 10 m/sec] | 100° C. · 2.2 min [Jet 10 m/sec] |
| Third chamber | 100° C. · 2.2 min [Jet 10 m/sec] | 100° C. · 2.2 min [Jet 10 m/sec] |
| Fourth chamber | 80° C. · 2.2 min [Jet 10 m/sec] | 100° C. · 2.2 min [Jet 10 m/sec] |
| Belt speed | 0.9 m/min | 0.9 m/min |
| Moisture content | 5% | 4.9% |
| Initial menthol content | 63.5% | 61.9% |
| Post-storage menthol content | 59.9% (30 days later) | 60.8% (30 days later) |
| Flavor retention rate | 94% | 98% |

In Sample Nos. 6 and 7, menthol-containing sheets were prepared using a hot air drying machine having four chambers of drying compartment.

In Sample No. 6, the initial drying (in the first to third chambers) was performed by hot air at a high temperature (110° C.→100° C.) for 6.6 minutes, and the latter drying (in the fourth chamber) was performed by hot air at a low temperature (80° C.) for 2.2 minutes. In Sample No. 6, a sufficiently dried sample (moisture content: 5%) can be prepared for a total drying time of 8.8 minutes. The "initial menthol content" after sheet preparation was as high as 63.5%, and the "post-storage menthol content" after stored (for 30 days) in the accelerated environments was also as high as 59.9%. Thus, both of flavor-retaining property after sheet preparation and post-storage flavor-retaining property were excellent. The results show that it was possible to prepare a sheet having an excellent flavor-retaining property in a relatively short drying time by employing the initial high temperature drying and the latter low temperature drying, though the hot air temperature sequentially is reduced from 110° C. to 100° C. during the initial drying.

In Sample No. 7, the hot air temperature was set to 100° C. in the whole period of the drying step, regardless of the initial drying and the latter drying. In Sample No. 7, the latter drying at a low temperature was not employed, but it is assumed that the sample temperature did not become too high in the process of drying the slurry due to the presence of the moisture in the sample, similarly to Sample Nos. 4 to 6. Specifically, in Sample No. 7, a sufficiently dried sample (moisture content: 4.9%) can be prepared for a total drying time of 8.8 minutes. The "initial menthol content" after sheet preparation was as high as 61.9%, and the "post-storage menthol content" after stored (for 30 days) in the accelerated environments was also as high as 60.8%. Thus, both of flavor-retaining property after sheet preparation and post-storage flavor-retaining property were excellent. The results show that it was possible to prepare a sheet having an excellent flavor-retaining property in a relatively short drying time, similarly to the cases of Sample Nos. 4 to 6, though the same hot air temperature (100° C.) was employed in the whole period of the drying step.

Example 4

In this example, temperature-responsive sol-gel transition characteristics of a polysaccharide solution (slurry) were examined.

Water 0.1 L

Gellan gum (KELCOGEL, San-Ei Gen F.F.I., Inc.) 5 g

Water (0.1 L) was kept at 70° C., and gellan gum (5 g) was added and dissolved therein in small portions so as not to form lumps, while stirring them using a high-performance mixer DMM (ATEC Japan Co., Ltd.), and a polysaccharide solution (slurry) was prepared.

Figure 2A:
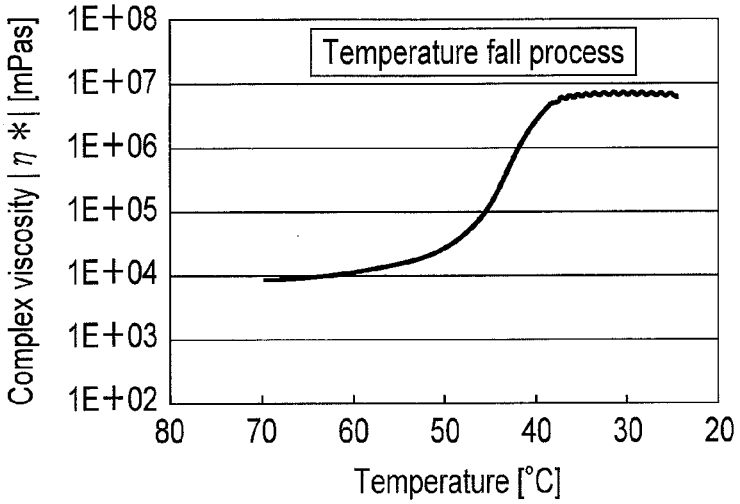
FIG. 2A is a graph showing changes in the viscosity followed by a fall in the temperature of aqueous gellan gum solution.
Figure 2B:
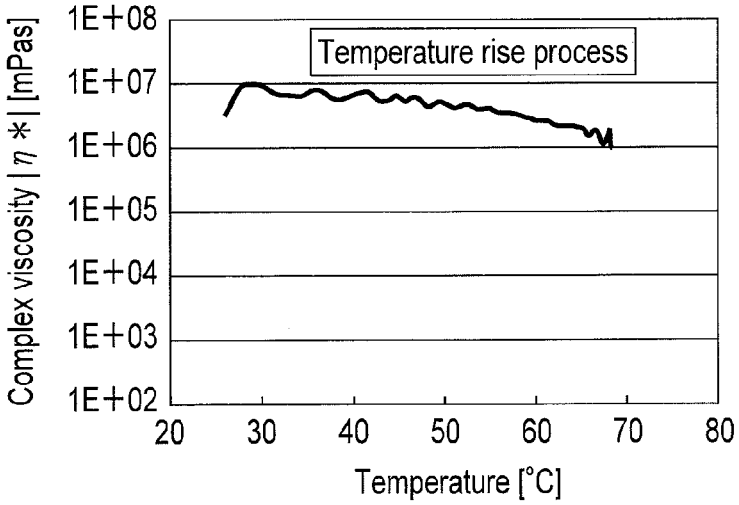
FIG. 2B is a graph showing changes in the viscosity followed by a rise in the temperature of aqueous gellan gum solution.

The temperature of the obtained slurry (70° C.) was decreased to 25° C. for about 900 seconds (0.05° C./sec.). Thereafter, the temperature was raised to 70° C. for about 900 seconds. FIGS. 2A and 2B show how the viscosity (fluidity) of the slurry was changed by the temperature change.

As shown in FIG. 2A, if the temperature of the slurry was decreased to 25° C. (cooling), the viscosity was low up to a temperature of 50° C. (the fluidity was high). However, the viscosity was suddenly increased at 40° C. or less (gelation phenomenon). If the temperature of the obtained gel was raised, the gel did not easily return to a sol state even if the temperature exceeded the gelation temperature (40° C.), as shown in FIG. 2B. Thus, the gel state was maintained up to a considerably high temperature.

The result shows that once the slurry containing polysaccharide is cooled and forms gel, the slurry is hard to return to a sol state even if the temperature is raised afterward, and thus the gel state can be maintained. The above property of the polysaccharide is utilized in the present invention, and the preliminary cooling is performed before drying the raw material slurry. As a result, it is expected that the polysaccharide contained in the raw material slurry after the preliminary cooling is hard to solate even if the temperature is raised at the time of drying, and the menthol coated with the polysaccharide is hard to volatilize.

Example 5

In this example, the sheets of Sample Nos. 1 to 7 were prepared as described in the Examples 1 to 3, and the temperature of the samples was measured during the drying step. Regarding the hot air drying conditions of the samples of Sample Nos. 1 to 7, it can be referred to Tables 1 to 3.

The measurement of the sample temperature was performed by directly measuring each sample (slurry) in the middle of the drying step using a non-contact thermometer (PT-7LD, manufactured by, OPTEX CO., LTD).

The measurement results of Sample Nos. 1 to 7 are shown in FIGS. 3A to 3G, respectively. In FIGS. 3A to 3G, the term "Cooling" means a sample prepared by blowing cold air (10° C.) on a slurry before the drying step and cooling to about 20° C., while the term "No cooling" means a sample prepared by casting a slurry and immediately drying it without performing the cooling process. The results of FIGS. 3A to 3G show that the cooling of the slurry does not affect on the temperature of each sample during the drying step.

Figure 3A:
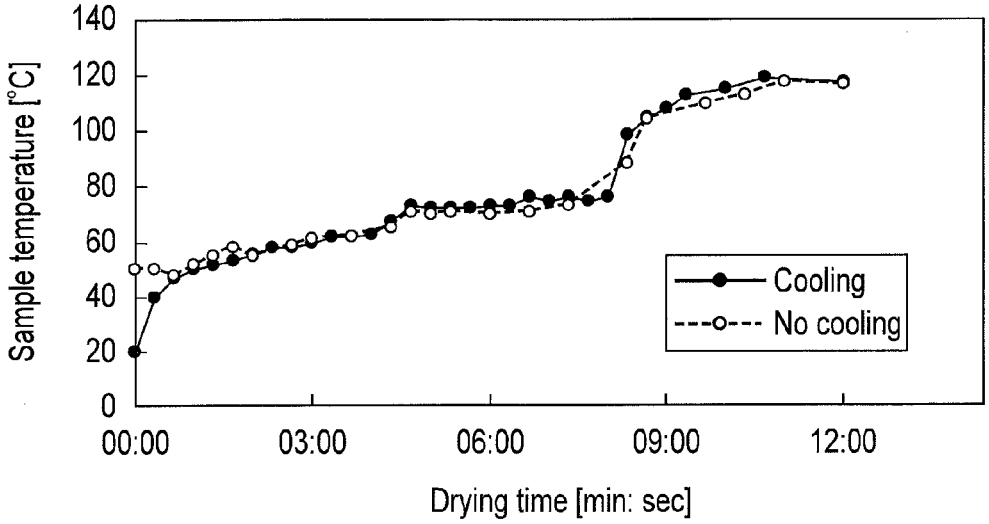
FIG. 3A is a graph showing the sample temperature of Sample No. 1 during the heat-drying step.

In Sample No. 1, the following hot air drying conditions were employed: at a hot air temperature of 70° C. for 4 minutes, at a hot air temperature of 80° C. for 4 minutes, and at a hot air temperature of 120° C. for 4 minutes. The sample temperature increased following a rise in hot air temperature. Finally, it exceeded 100° C. and reached nearly 120° C. (FIG. 3A). As shown, the "post-storage menthol content" of the sheet of Sample No. 1 is as low as 13.6% (Table 1). It is estimated that the internal structure of the sheet was destroyed by the high sample temperature and thus the post-storage menthol content was reduced.

Figure 3B:
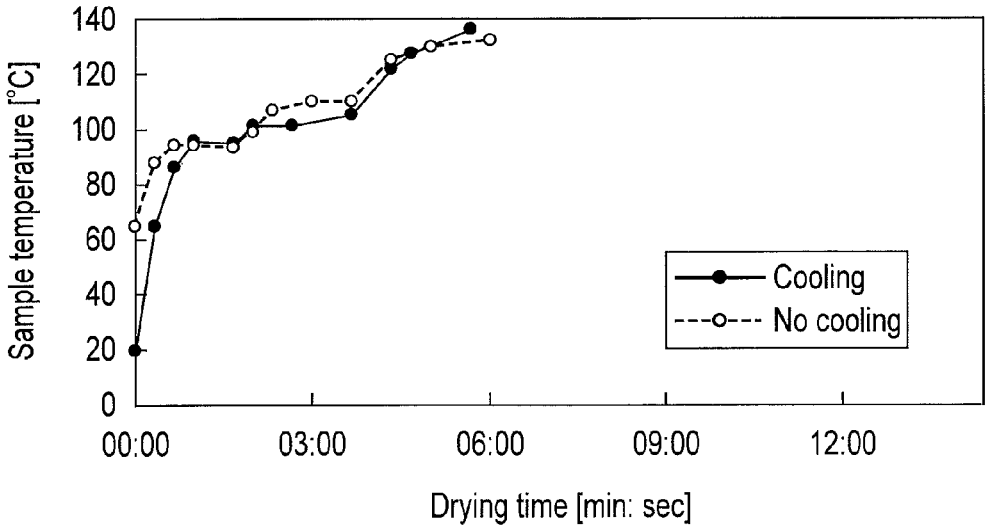
FIG. 3B is a graph showing the sample temperature of Sample No. 2 during the heat-drying step.

In Sample No. 2, the following hot air drying conditions were employed: at a hot air temperature of 120° C. for 2 minutes, at a hot air temperature of 130° C. for 2 minutes, and at a hot air temperature of 176° C. for 2 minutes. The sample temperature increased following a rise in hot air temperature. Finally, it exceeded 100° C. and reached nearly 140° C. (FIG. 3B). As shown, the "post-storage menthol content" of the sheet of Sample No. 2 is as low as 29.2% (Table 1). It is estimated that the internal structure of the sheet was destroyed by the high sample temperature and thus the post-storage menthol content was reduced.

Figure 3C:
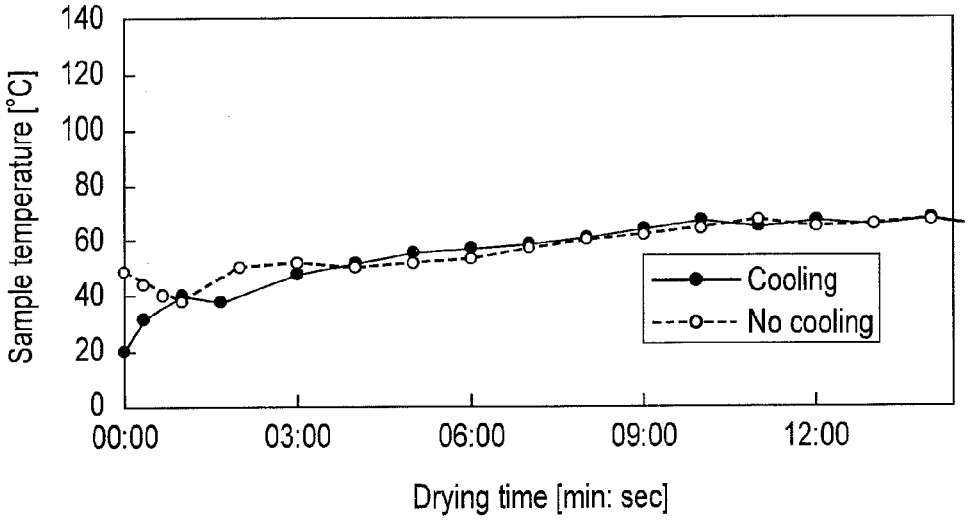
FIG. 3C is a graph showing the sample temperature of Sample No. 3 during the heat-drying step.

In Sample No. 3, the hot air drying at a hot air temperature of 70° C. for 60 minutes was employed as the hot air drying conditions. FIG. 3C shows the sample temperature from the start of drying to 14 minutes after drying. The sample temperature did not exceed 70° C. over the total drying time. As shown, the "post-storage menthol content" of the sheet of Sample No. 3 is as high as 59.2% (Table 1). It is estimated that the sheet of Sample No. 3 did not reach a high temperature over the total drying time and thus the high menthol content can be maintained after storage in the accelerated environments. However, the sheet of Sample No. 3 was dried at a sample temperature of less than 70° C., and thus 60 minutes were necessary for the drying.

Figure 3D:
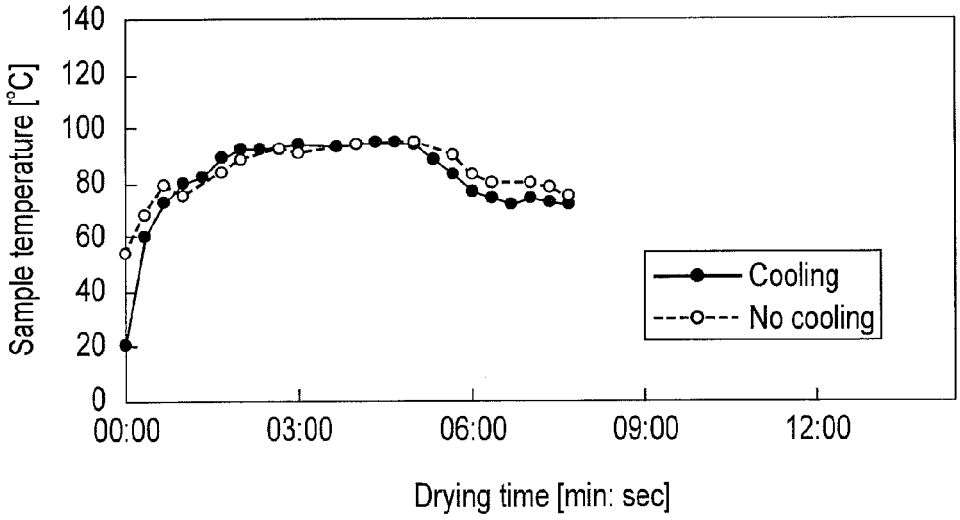
FIG. 3D is a graph showing the sample temperature of Sample No. 4 during the heat-drying step.

In Sample No. 4, the following hot air drying conditions were employed: at a hot air temperature of 120° C. for 5 minutes and at a hot air temperature of 70° C. for 2.5 minutes. The sample temperature reached up to 95° C. under the hot air of 120° C., and decreased to 72° C. under the hot air of 70° C. (FIG. 3D). As shown, the "post-storage menthol content" of the sheet of Sample No. 4 is as high as 62.4% (Table 1). It is estimated that the sheet of Sample No. 4 was kept at a sample temperature lower than those of Sample Nos. 1 and 2 over the total drying time and thus the high menthol content can be maintained after storage in the accelerated environments.

Figure 3E:
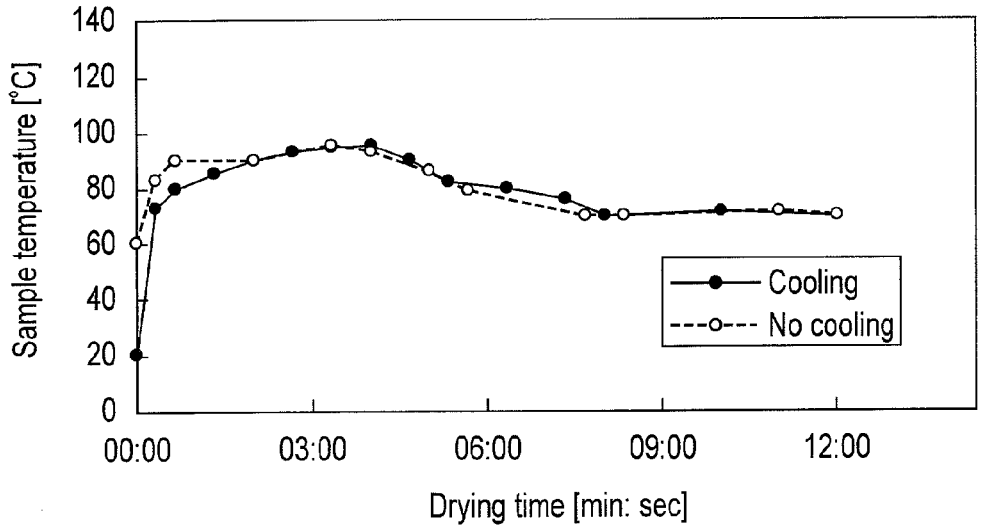
FIG. 3E is a graph showing the sample temperature of Sample No. 5 during the heat-drying step.

In Sample No. 5, the following hot air drying conditions were employed: at a hot air temperature of 120° C. for 4 minutes and at a hot air temperature of 70° C. for 8 minutes. The sample temperature reached up to 95° C. under the hot air of 120° C., and decreased to 70° C. under the hot air of 70° C. (FIG. 3E). As shown, the "post-storage menthol content" of the sheet of Sample No. 5 is as high as 58.5% (Table 2). It is estimated that the sheet of Sample No. 5 was kept at a sample temperature lower than those of Sample Nos. 1 and 2 over the total drying time and thus the high menthol content can be maintained after storage in the accelerated environments.

Figure 3F:
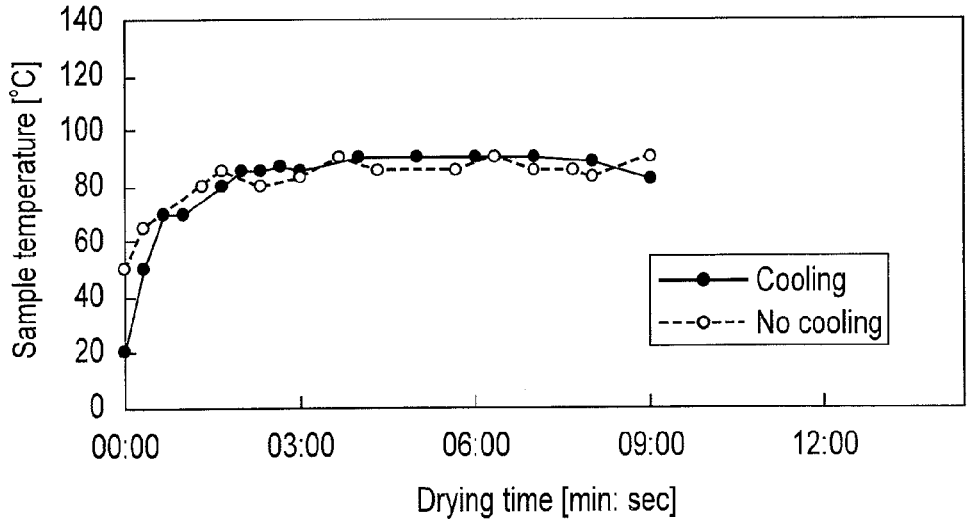
FIG. 3F is a graph showing the sample temperature of Sample No. 6 during the heat-drying step.

In Sample No. 6, the following hot air drying conditions were employed: at a hot air temperature of 110° C. for 2.2 minutes, at a hot air temperature of 100° C. for 4.4 minutes, and at a hot air temperature of 80° C. for 2.2 minutes. The sample temperature was maintained within a range of about 80 to 90° C. (FIG. 3F). As shown, the "post-storage menthol content" of the sheet of Sample No. 6 is as high as 59.9% (Table 3). It is estimated that the sheet of Sample No. 6 was kept at a sample temperature lower than those of Sample Nos. 1 and 2 over the total drying time and thus the high menthol content can be maintained after storage in the accelerated environments.

Figure 3G:
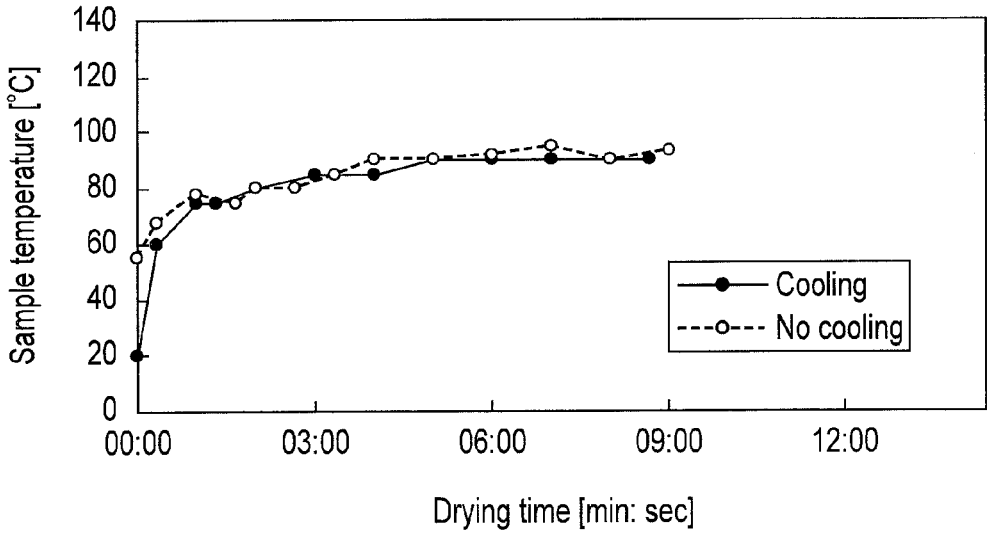
FIG. 3G is a graph showing the sample temperature of Sample No. 7 during the heat-drying step.

In Sample No. 7, the hot air drying at a hot air temperature of 100° C. for 8.8 minutes were employed as the hot air drying conditions. The sample temperature was maintained within a range of about 80 to 90° C. (FIG. 3G). As shown, the "post-storage menthol content" of the sheet of Sample No. 7 is as high as 60.8% (Table 3). It is estimated that the sheet of Sample No. 7 was kept at a sample temperature lower than those of Sample Nos. 1 and 2 over the total drying time and thus the high menthol content can be maintained after storage in the accelerated environments.

The above results show that if the slurry is dried at a sample temperature which does not exceed 100° C. over the total drying time, a high "post-storage menthol content" can be maintained. Further, it is found that if the slurry is dried at a sample temperature of 70 to 100° C. over the total drying time (except for about 1 minute at the beginning of the drying time), it is possible to form a menthol-containing sheet in a shorter time.

Example 6

In this example, it is demonstrated that the slurry cooling process before the drying step has an effect on the "post-storage menthol content" of the menthol-containing sheets. Specifically, the sheets of Sample Nos. 1 to 7 were prepared as described in Examples 1 to 3. In each of the sheets of Sample Nos. 1 to 7, the "post-storage menthol content" of the sheet prepared through the slurry cooling process was compared with the "post-storage menthol content" of the sheet prepared without the slurry cooling process. As described in Example 1, each sheet was stored in the thermostat set at 50° C. for 7, 14, and 30 days.

The measurement results of Sample Nos. 1 to 3 are shown in FIG. 4A and the measurement results of Sample Nos. 4 to 7 are shown in FIG. 4B. In FIGS. 4A and 4B, the term "Cooling" means a sample prepared by blowing cold air (10° C.) on a slurry before the drying step and cooling to about 20° C., while the term "No cooling" means a sample prepared by casting a slurry and immediately drying it without performing the cooling process. In the samples of "No cooling", the slurry temperature was not less than 50° C. during the casting and drying of the slurry.

The data of "Cooling" in FIGS. 4A and 4B are the same as those in FIG. 1.

In the sheets of Sample Nos. 1 and 2, the menthol content after storage for 30 days was low without reaching 30%, regardless of the presence or absence of the cooling process.

In the sheets of Sample No. 3, the menthol content after storage for 30 days was greater than 50%, regardless of the presence or absence of the cooling process. However, the drying time of 60 minutes was necessary for preparing the sheet of Sample No. 3.

In the sheets of Sample No. 4, the menthol content after storage for 30 days was decreased to 18% in the case of "No cooling", while the menthol content after storage for 30 days was maintained to 62% in the case of "Cooling".

In the sheets of Sample No. 5, the menthol content after storage for 30 days was decreased to 20% in the case of "No cooling", while the menthol content after storage for 30 days was maintained to 59% in the case of "Cooling".

In the sheets of Sample No. 6, the menthol content after storage for 30 days was decreased to 20% in the case of "No cooling", while the menthol content after storage for 30 days was maintained to 60% in the case of "Cooling".

In the sheets of Sample No. 7, the menthol content after storage for 30 days was decreased to 12% in the case of "No cooling", while the menthol content after storage for 30 days was maintained to 61% in the case of "Cooling".

The above results show that when the raw material slurry is once cooled and dried at a sample temperature of 70 to 100° C. to prepare a menthol-containing sheet, it is possible to form the sheet in a shorter time and keep the post-storage menthol content high.

Example 7

In this example, a relationship between the cooling temperature of the slurry and the "initial menthol content" of the menthol-containing sheets was examined. Specifically, in the sheet of Sample No. 6 described in Example 3, the cooling temperature of the slurry was changed to 20° C., 30° C., 40° C., 50° C., and 60° C., and various sheets were prepared. The menthol content of the sheet immediately after preparation, i.e., "initial menthol content" was measured.

The measurement results are shown in FIG. 5. From the results of FIG. 5, it was observed that the menthol content of the sheet tended to increase as the cooling temperature was lower. Specifically, the sheets showed the following initial menthol content: 64% when the cooling temperature was 20° C., 61% when the cooling temperature was 30° C., 57% when the cooling temperature was 40° C., 52% when the cooling temperature was 50° C., and 43% when the cooling temperature was 60° C.

In Example 4 described above, it is shown that the slurry forms gel at a cooling temperature of 40° C. or less, and that once the slurry containing polysaccharide is cooled and forms gel, the slurry is hard to return to a sol state even if the temperature is raised afterward. Further, it is generally known that if the temperature of the emulsion is less than 0° C., the emulsion is frozen and destroyed.

From these results, it is found that cooling temperatures is preferably 0 to 40° C., more preferably 0 to 30° C.

Example 8

In this example, a relationship between the moisture content of the menthol-containing sheets and the menthol flavor retention rate was examined. Specifically, in the sheet of Sample No. 6 described in Example 3, the total drying time of the slurry was changed to 8.16 minutes, 7.92 minutes, 7.64 minutes, 7.44 minutes, and 7.08 minutes by increasing the conveying speed of the belt in the hot air drying machine, and sheets having various moisture contents were prepared. The moisture content of the prepared sheets was measured. The preparation conditions and moisture content of the sheets are shown in Table 4 below.

TABLE 4

| | Sample Nos. | | | | |
|---|---|---|---|---|---|
| | 8-1 | 8-2 | 8-3 | 8-4 | 8-5 |
| Belt conveying speed | 1.13 m/min | 1.07 m/min | 1.04 m/min | 1.01 m/min | 0.98 m/min |
| Total drying time | 7.08 min | 7.44 min | 7.64 min | 7.92 min | 8.16 min |
| Moisture content after drying | 22.6 wt % | 14.6 wt % | 11.2 wt % | 8.6 wt % | 6.1 wt % |

The prepared sheets were stored in the thermostat set at 50° C. for 30 days as described in Example 1. The menthol content was measured as to the sheets immediately after preparation and the sheets after storage. The measurement results are shown in Table 5 below as "the initial menthol content" and "the menthol content of the sheets stored immediately after preparation". The menthol flavor retention rate was calculated from the values of the menthol content using Equation below.

$$\text{Menthol flavor retention rate (\%)}=\{(\text{post-storage menthol content})/(\text{initial menthol content})\}\times 100$$

Figure 6:
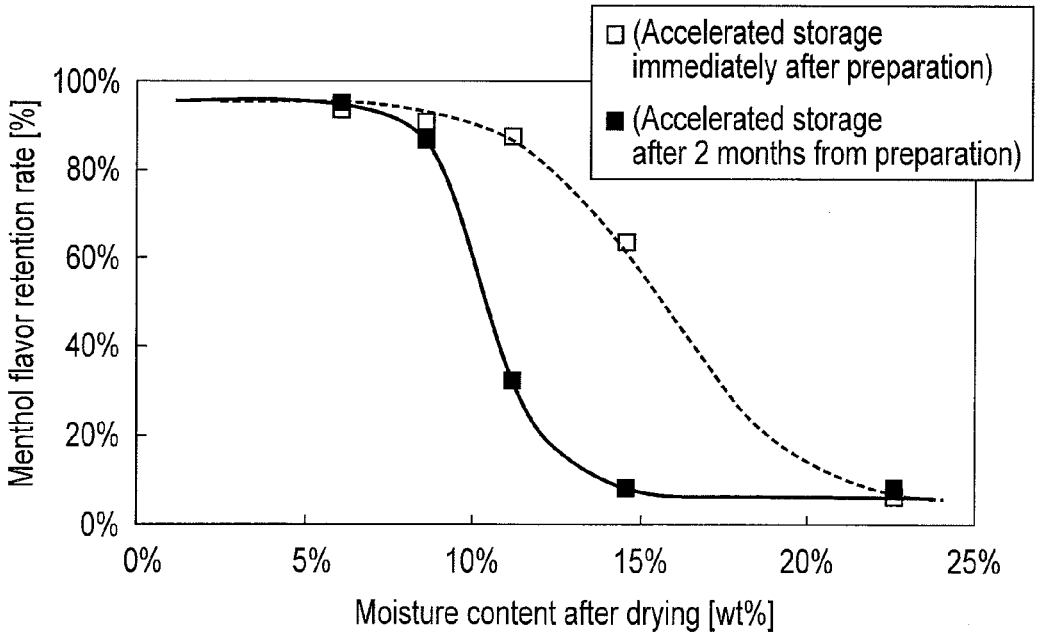
FIG. 6 is a graph showing a relationship between the moisture content of the menthol-containing sheets and the menthol flavor retention rate.

The results are shown in FIG. 6 as "the accelerated storage immediately after preparation".

Further, the sheets were allowed to stand for 2 months after preparation, and they were stored in the thermostat set at 50° C. for 30 days as described in Example 1. The menthol content was measured as to the sheets immediately after preparation and the sheets after storage. The measurement results are shown in Table 5 below as "the initial menthol content" and "the menthol content of the sheets stored after 2 months from preparation". The menthol flavor retention rate was calculated by the above equation. The results are shown in FIG. 6 as "the accelerated storage after 2 months from preparation".

TABLE 5

| | Sample Nos. | | | | |
|---|---|---|---|---|---|
| | 8-1 | 8-2 | 8-3 | 8-4 | 8-5 |
| Moisture content after drying | 22.6 wt % | 14.6 wt % | 11.2 wt % | 8.6 wt % | 6.1 wt % |
| Initial menthol content | 51.0% | 56.5% | 59.5% | 62.2% | 61.0% |
| Menthol content of sheets stored immediately after preparation | 3.0% | 35.6% | 51.9% | 56.3% | 56.8% |
| Menthol content of sheets stored after 2 months from preparation | 3.9% | 4.4% | 18.1% | 50.2% | 56.8% |

The menthol content of the sheet immediately after preparation was about 50 to 60% in all the cases of Sample Nos. 8-1 to 8-5.

In the experiments in which the sheets immediately after preparation were stored in the accelerated environments, the following results was shown: the sheet (Sample No. 8-5) having a moisture content of about 6% had a menthol flavor retention rate of 93%, the sheet (Sample No. 8-4) having a moisture content of about 9% had a menthol flavor retention rate of 90%, the sheet (Sample No. 8-3) having a moisture content of about 11% had a menthol flavor retention rate of 87%, the sheet (Sample No. 8-2) having a moisture content of about 15% had a menthol flavor retention rate of 63%, and the sheet (Sample No. 8-1) having a moisture content of about 23% had a menthol flavor retention rate of 6%.

In the experiments in which the sheets after 2 months from preparation were stored in the accelerated environments, the following results were shown: the sheet (Sample No. 8-5) having a moisture content of about 6% had a menthol flavor retention rate of 95%, the sheet (Sample No. 8-4) having a moisture content of about 9% had a menthol flavor retention rate of 87%, the sheet (Sample No. 8-3) having a moisture content of about 11% had a menthol flavor retention rate of 32%, the sheet (Sample No. 8-2) having a moisture content of about 15% had a menthol flavor retention rate of 8%, and the sheet (Sample No. 8-1) having a moisture content of about 23% had a menthol flavor retention rate of 8%.

These results show that if the moisture content of the sheet becomes high, the menthol flavor retention rate is suddenly decreased, and thus the sheet is preferably dried so that the moisture content of the sheet is less than 10%, preferably 9% or less. Particularly, it is found that even if the sheet after 2 months from preparation is further stored in the accelerated environments, it is possible to maintain a high menthol flavor retention rate by lowering the moisture content of the sheet to about 9% or less.

When the moisture content of the sheet is decreased to less than 3%, the menthol flavor retention rate is excellent. However, "cracking" or "peeling" occurs on the sheet in this case. Thus, the moisture content of the sheet after drying is preferably 3% or more.

Example 9

In this example, an effect of the composition of polysaccharide (i.e., a mixture of gellan gum and tamarind gum, a mixture of gellan gum and locust bean gum, and a mixture of gellan gum and starch) on the menthol content of the menthol-containing sheets was examined.

9-1. Method (Preparation of Sheet)

(1) Sheet Containing Gellan Gum and Tamarind Gum

The composition of the raw material slurries was as described below.

Water 10 L

Polysaccharide (mixture of gellan gum and tamarind gum) 300 g

5% aqueous lecithin solution (SUN LECITHIN A-1, Taiyo Kagaku Co., Ltd.) 120 mL

Menthol (Takasago International Corporation.) 1500 g

The mixing ratio (weight ratio) of gellan gum and tamarind gum was changed as follows.

Gellan gum:tamarind gum=100:0

Gellan gum:tamarind gum=75:25

Gellan gum:tamarind gum=50:50 Gellan gum:tamarind gum=33:67 Gellan gum:tamarind gum=17:83

As gellan gum, KELCOGEL (San-Ei Gen F.F.I., Inc., deacylated gellan gum) was used. As tamarind gum, Bistop D-2032 (San-Ei Gen F.F.I., Inc.) was used.

300 g (3 parts by weight) of polysaccharide consisting of gellan gum and tamarind gum at the above mixing ratio (weight ratio) were added to 10 L (100 parts by weight) of water (heated and kept at 80° C.) and dissolved therein in small portions so as not to form lumps (the time required: about 20 minutes), while stirring them with a mixer (PRI-MIX T.K. AUTO MIXER Model 40/equipped with a rotor for stirring a solution/2000 rpm). 1500 g (15 parts by weight) of 1-menthol was added at the same temperature. The stirring mixer was replaced with a homogenizer (PRI-MIX T.K. AUTO MIXER Model 40/equipped with a rotor-stator head/4000 rpm) and the mixture was emulsified for 10 minutes. Then, 120 ml (1.2 parts by weight) of 5% aqueous lecithin solution was added thereto, and they were stirred. Menthol was dispersed in the mixed polysaccharide solution of gellan gum and tamarind gum.

The dispersed slurry was casted onto the substrate (PET film, FE2001, FUTAMURA CHEMICAL CO., LTD.) so as to have a thickness of 1 mm (wet state). Thereafter, the slurry was cooled to about 20° C. using the cold air of about 10° C. generated by a spot cooler (Suiden SS-25DD-1).

Then, the cooled slurry was subjected to dry forming using a hot air drying machine in accordance with the same procedure as Example 1 so as to have a moisture content of about 6%, and thereby a sheet (hereinafter referred to as a "sheet containing gellan gum and tamarind gum) was prepared. The moisture content was measured by GC-TCD (see Example 1). The following hot air drying conditions were employed: at a hot air temperature of 110° C. for 3 minutes, at a hot air temperature of 100° C. for 6 minutes, and at a hot air temperature of 8° C. for 3 minutes (the total drying time: 12 minutes).

(2) Sheet Containing Gellan Gum and Locust Bean Gum

A raw material slurry containing gellan gum and locust bean gum (reagent, Wako Pure Chemical Industries, Ltd.) at the following mixing ratios (weight ratios) was prepared in accordance with the same procedure as that of (1) Sheet containing gellan gum and tamarind gum. The composition of the raw material slurry is the same as the case of (1) Sheet containing gellan gum and tamarind gum except for the polysaccharide.

Gellan gum:locust bean gum=100:0

Gellan gum:locust bean gum=83:17

Gellan gum:locust bean gum=67:33

Gellan gum:locust bean gum=50:50

Gellan gum:locust bean gum=33:67

Gellan gum:locust bean gum=17:83

Gellan gum:locust bean gum=0:100

A sheet (hereinafter referred to as a "sheet containing gellan gum and locust bean gum") was prepared using the raw material slurry in accordance with the same procedure as Example 1.

(3) Sheet Containing Gellan Gum and Starch

A raw material slurry containing gellan gum and starch at a mixing ratio (weight ratio) of 50:50 was prepared in accordance with the same procedure as that of (1) Sheet containing gellan gum and tamarind gum. The composition of the raw material slurry is the same as the case of (1) Sheet containing gellan gum and tamarind gum except for the polysaccharide.

Two types of "starch were used: "starch derived from corn (Wako Pure Chemical Industries, Ltd., special grade reagent)" as "normal starch" and "starch (soluble) (Wako Pure Chemical Industries, Ltd., first grade reagent)" as "soluble starch". In either case where the normal starch or the soluble starch is used, the viscosity of the raw material slurry was low, and thus it was difficult to maintain the thickness of the sample when it was casted. Accordingly, only the ratio 50:50 was employed as the mixing ratio of gellan gum and starch.

A sheet (hereinafter referred to as a "sheet containing gellan gum and starch") was prepared using the raw material slurry in accordance with the same procedure as (1).

9-2. Method (Measurement of Menthol Content)

Figure 7A:
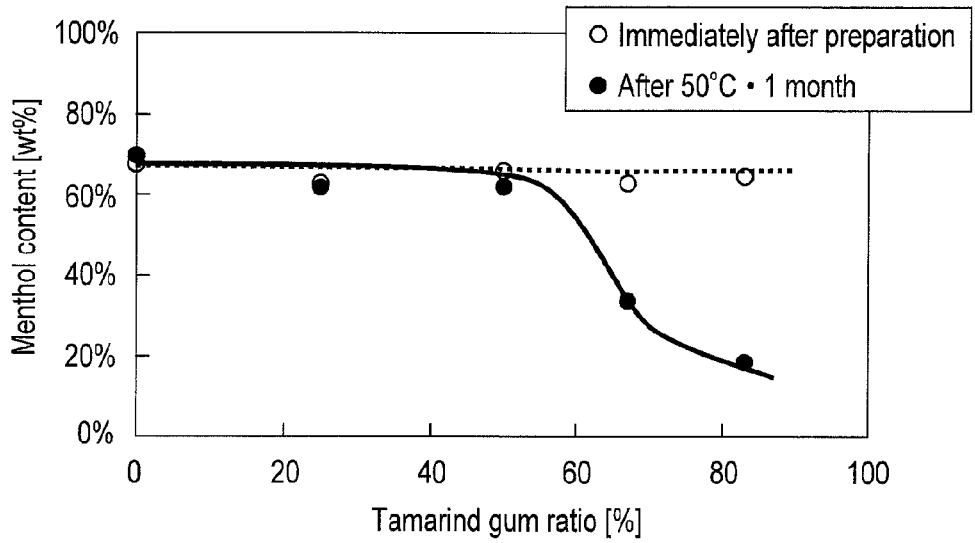
FIG. 7A is a graph showing a relationship between the blending ratio of tamarind gum and the menthol content of the sheets containing gellan gum and tamarind gum.
Figure 7B:
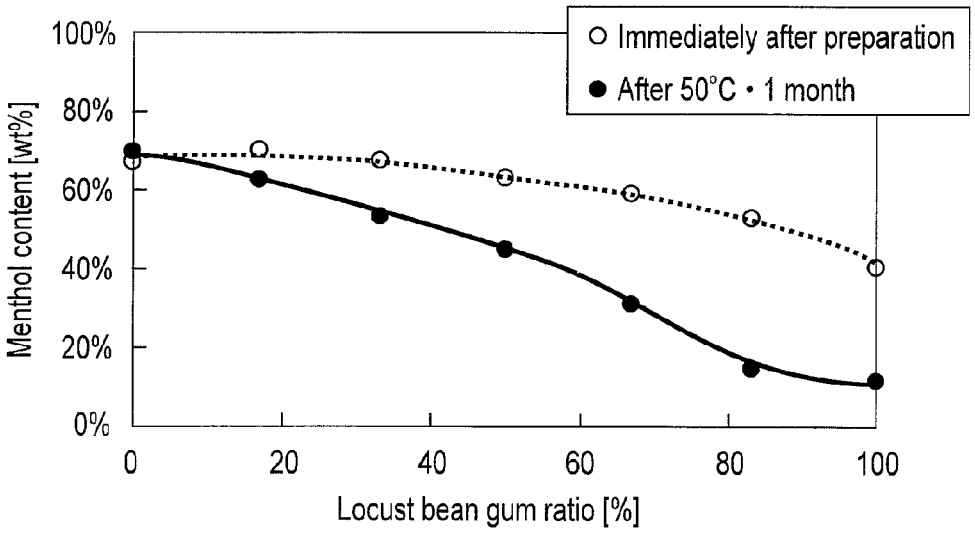
FIG. 7B is a graph showing a relationship between the blending ratio of locust bean gum and the menthol content of the sheets containing gellan gum and locust bean gum.
Figure 7C:
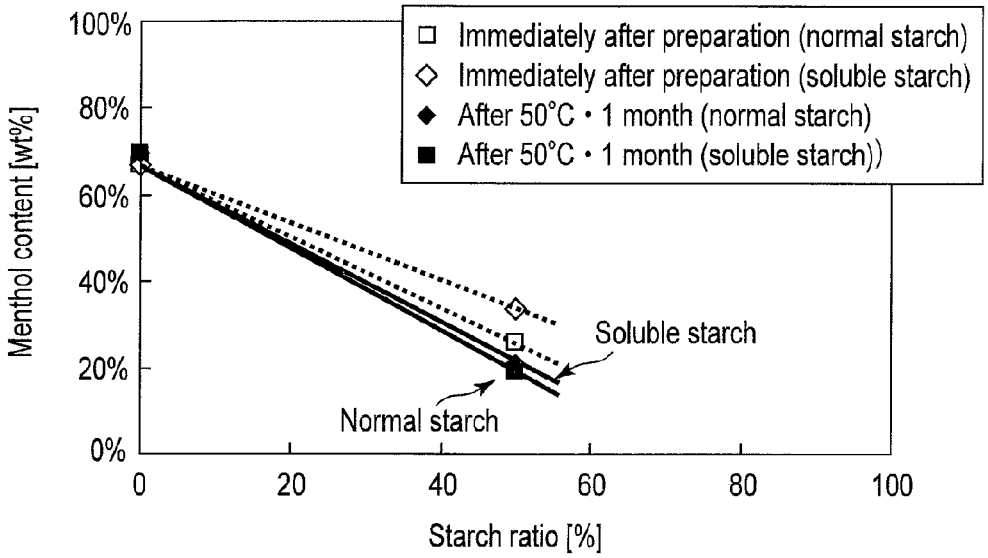
FIG. 7C is a graph showing a relationship between the blending ratio of starch and the menthol content of the sheets containing gellan gum and starch.

The menthol content of the sheet immediately after preparation (the initial menthol content) and the menthol content of the sheet stored in accelerated environments (the post-storage menthol content) were measured. The accelerated environments were as described in Example 1. The measurement of the menthol content was performed in accordance with the same procedure as Example 1. The results of the sheet containing gellan gum and tamarind gum are shown in FIG. 7A, the results of the sheet containing gellan gum and locust bean gum are shown in FIG. 7B, and the results of the sheet containing gellan gum and starch are shown in FIG. 7C. In FIGS. 7A to 7C, the term "immediately after preparation" means a sheet immediately after the preparation, and the term "after 50° C.·1 month" means a sheet after storage at 50° C. for 30 days.

9-3. Results (1) Sheet Containing Gellan Gum and Tamarind Gum

As shown in FIG. 7A, the initial menthol content showed a high value exceeding 60% in all the sheets, regardless of the mixing ratio of gellan gum and tamarind gum. The post-storage menthol content was maintained at a high value corresponding to the same level as the initial menthol content (about 60% or more), when the mixing ratios of gellan gum and tamarind gum were 100:0, 75:25, and 50:50. On the other hand, when the mixing ratios of gellan gum and tamarind gum were 33:67 and 17:83, the post-storage menthol content was decreased to 33% and 18%, respectively.

(2) Sheet Containing Gellan Gum and Locust Bean Gum

As shown in FIG. 7B, as the blending ratio of locust bean gum increases, the menthol content tended to decrease in both of the sheets immediately after preparation and the sheets after storage. Specifically, when the blending ratio of locust bean gum was 17%, the initial menthol content was about 70% and the post-storage menthol content was about 63%. When the blending ratio was 33%, the initial menthol content was about 68% and the post-storage menthol content was about 54%. When the blending ratio was 50%, the initial menthol content was about 63% and the post-storage menthol content was about 45%. When the blending ratio was 67%, the initial menthol content was about 59% and the post-storage menthol content was about 31%. When the blending ratio was 83%, the initial menthol content was about 53% and the post-storage menthol content was about 15%.

(3) Sheet Containing Gellan Gum and Starch

As shown in FIG. 7C, when normal starch was contained at a blending ratio of 50%, the initial menthol content was about 26% and the post-storage menthol content was about 19%. When soluble starch was contained at a blending ratio of 50%, the initial menthol content was about 34% and the post-storage menthol content was about 21%.

Example 10

In this example, the emulsion stability of the raw material slurry containing only gellan gum as polysaccharide was compared with the emulsion stability of the raw material slurry containing gellan gum and tamarind gum at a weight ratio of 1:1 as polysaccharide. The emulsion stability was evaluated by examining how the menthol content of the prepared sheet was changed in response to the blending amount of the emulsifier.

Lecithin was used as the emulsifier. The addition amount of lecithin was changed in a range of 0.001 to 0.4 times the weight of polysaccharide (gellan gum alone or a mixture of gellan gum and tamarind gum) in the raw material slurry. That is, the addition amount of lecithin was 0.001, 0.005, 0.01, 0.02, 0.05, 0.1, 0.2 or 0.4 times the weight of polysaccharide.

10-1. Method (Preparation of Sheet)

(1) Preparation of sheet using raw material slurry containing only gellan gum as polysaccharide Water 10 L Gellan gum (KELCOGEL, San-Ei Gen F.F.I., Inc.) 300 g 5% aqueous lecithin solution (SUN LECITHIN A-1, Taiyo Kagaku Co., Ltd.)

6 ml (0.001-fold amount) to 300 ml (0.05-fold amount)

or Lecithin powder (SUN LECITHIN A-1 (powder), Taiyo Kagaku Co., Ltd.)

30 g (0.1-fold amount) to 120 g (0.4-fold amount) Menthol (Takasago International Corporation.) 1500 g The above composition of the raw material slurry was used and a sheet (hereinafter referred to as "gellan gum-containing sheet) was prepared in accordance with the same procedure as Example 9.

(2) Preparation of sheet using raw material slurry containing gellan gum and tamarind gum at weight ratio of 1:1 as polysaccharide Water 10 L Gellan gum (KELCOGEL, San-Ei Gen F.F.I., Inc.) 150 g Tamarind gum (BISTOP D-2032, San-Ei Gen F.F.I., Inc.) 150 g 5% aqueous lecithin solution (SUN LECITHIN A-1, Taiyo Kagaku Co., Ltd.)

6 ml (0.001-fold amount) to 300 ml (0.05-fold amount)

or Lecithin powder (SUN LECITHIN A-1 (powder), Taiyo Kagaku Co., Ltd.)

30 g (0.1-fold amount) to 120 g (0.4-fold amount) Menthol (Takasago International Corporation.) 1500 g The above composition of the raw material slurry was used and a sheet (hereinafter referred to as "sheet containing gellan gum and tamarind gum") was prepared in accordance with the same procedure as Example 9.

10-2. Method (Measurement of Menthol Content)

Figure 8A:
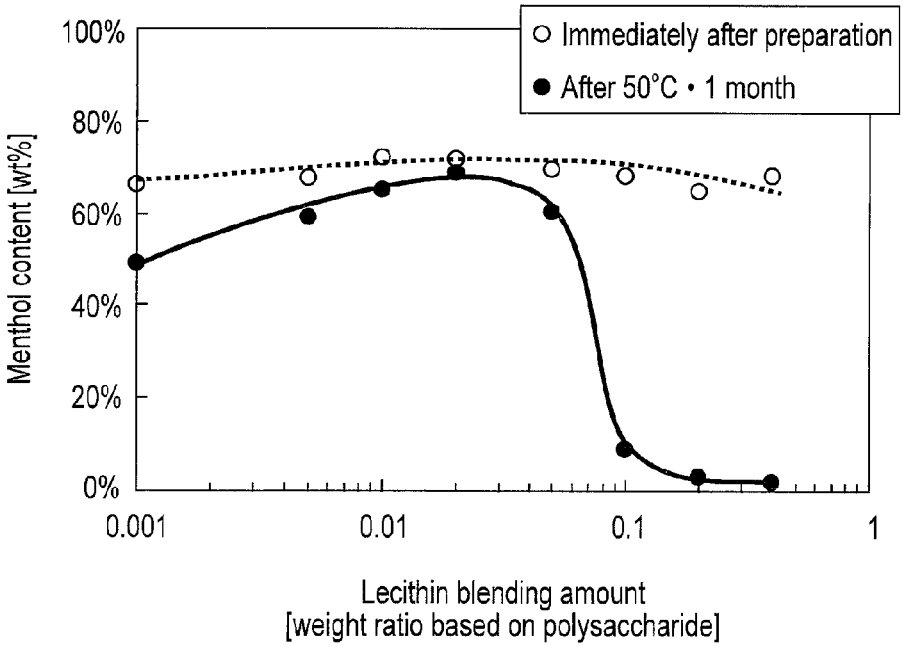
FIG. 8A is a graph showing a relationship between the blending amount of lecithin and the menthol content of the menthol-containing sheets (the case where gellan gum is used as the polysaccharide).
Figure 8B:
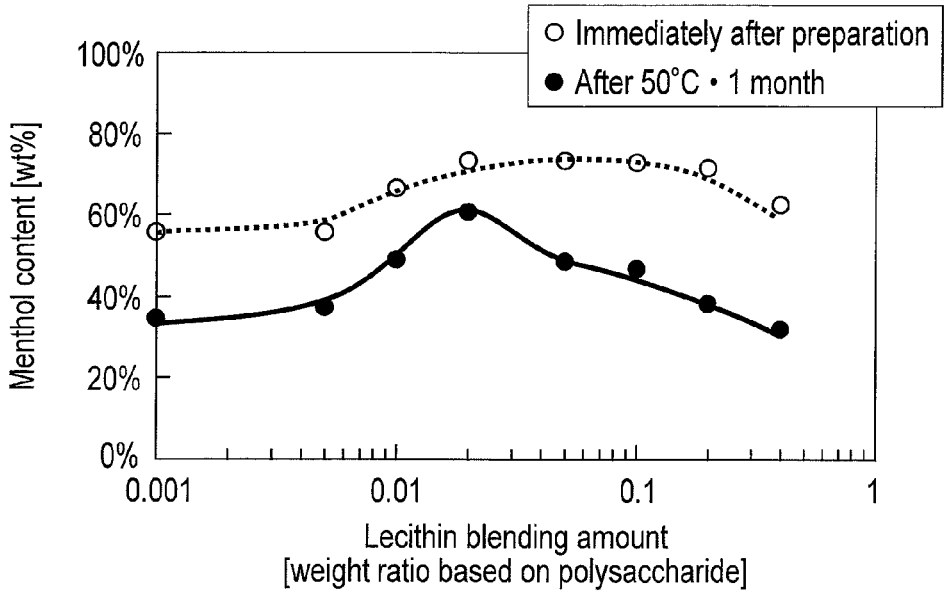
FIG. 8B is a graph showing a relationship between the blending amount of lecithin and the menthol content of the menthol-containing sheets (the case where gellan gum and tamarind gum are used in combination as polysaccharide).

The menthol content of the sheet immediately after preparation (the initial menthol content) and the menthol content of the sheet stored in accelerated environments (the post-storage menthol content) were measured. The accelerated environments were as described in Example 1. The measurement of the menthol content was performed in accordance with the same procedure as Example 1. The results of the gellan gum-containing sheet are shown in FIG. 8A. The results of the sheet containing gellan gum and tamarind gum are shown in FIG. 8B. In FIGS. 8A and 8B, the term "immediately after preparation" means a sheet immediately after the preparation, and the term "after 50° C.·1 month" means a sheet after storage at 50° C. for 30 days.

10-3. Results

FIG. 8A shows a relationship between the blending amount of lecithin in the gellan gum-containing sheet (weight ratio based on the gellan gum) and the menthol content (%). As shown in FIG. 8A, the initial menthol content showed a high value exceeding 60% in all the sheets, without depending on the blending amount of lecithin. The post-storage menthol content was maintained at a high value corresponding to the same level as the initial menthol content (about 60% or more), when the blending amounts of lecithin were 0.005 to 0.05 times the weight of gellan gum. On the other hand, when the blending amounts of lecithin were 0.1, 0.2, and 0.4 times the weight of gellan gum, the post-storage menthol content was decreased to 9%, 3%, and 2%, respectively. These results show that if lecithin was contained at a high concentration in raw material, a stable emulsified state of the raw material was not obtained.

FIG. 8B shows a relationship between the blending amount of lecithin in the sheet containing gellan gum and tamarind gum (weight ratio based on the mixture of gellan gum and tamarind gum) and the menthol content (%). As shown in FIG. 8B, the initial menthol content showed a high value of about 56 to 73% in all the sheets having various blending amounts of lecithin. The post-storage menthol content showed a relatively high value (about 47 to 61%) when the blending amounts of lecithin were 0.01 to 0.1 times the weight of polysaccharide. These results were different from those of the gellan gum-containing sheets. That is, even when the blending amount of lecithin exceeded 0.05 times the weight of polysaccharide, the post-storage menthol content was maintained at a relatively high level. These results show that even if the blending amount of lecithin was high, the emulsified state of the raw material was stably maintained because of the use of gellan gum in combination with tamarind gum as polysaccharide.

Example 11

In this example, an effect of the composition of polysaccharide (that is, the mixing ratio of gellan gum and tamarind gum) on the emulsion stability of the raw material slurry was examined. The emulsion stability was evaluated by examining how the menthol content of the prepared sheet was changed after the prepared raw material slurry was left to stand for a predetermined time. Specifically, the prepared raw material slurry was left to stand for a predetermined time and then heated again to convert to sol, and a menthol-containing sheet was prepared. Using the sheet, the effect of the composition of polysaccharide (that is, the mixing ratio of gellan gum and tamarind gum) on the menthol content was examined.

11-1. Method (Preparation of Sheet)

Raw material slurries containing gellan gum and tamarind gum at the following mixing ratio (weight ratio) as polysaccharide were prepared in accordance with the same procedure as Example 9. The composition of the raw material slurries was the same as the case of (1) Sheet containing gellan gum and tamarind gum in Example 9.

Gellan gum:tamarind gum=100:0

Gellan gum:tamarind gum=75:25

Gellan gum:tamarind gum=50:50

Gellan gum:tamarind gum=25:75

The prepared raw material slurries were placed in each polystyrene container and left to stand at room temperature overnight. The raw material slurries were cooled and gelatinized. Thereafter, the gelatinized raw materials were heated to 80° C. or more using a microwave cooker (output power: 500 W, microwave oven), and then they were converted to sol. Sheets (hereinafter referred to as "sheets containing gellan gum and tamarind gum") were prepared using the obtained raw material slurries in accordance with the same procedure as Example 9.

11-2. Method (Measurement of Menthol Content)

Figure 9:
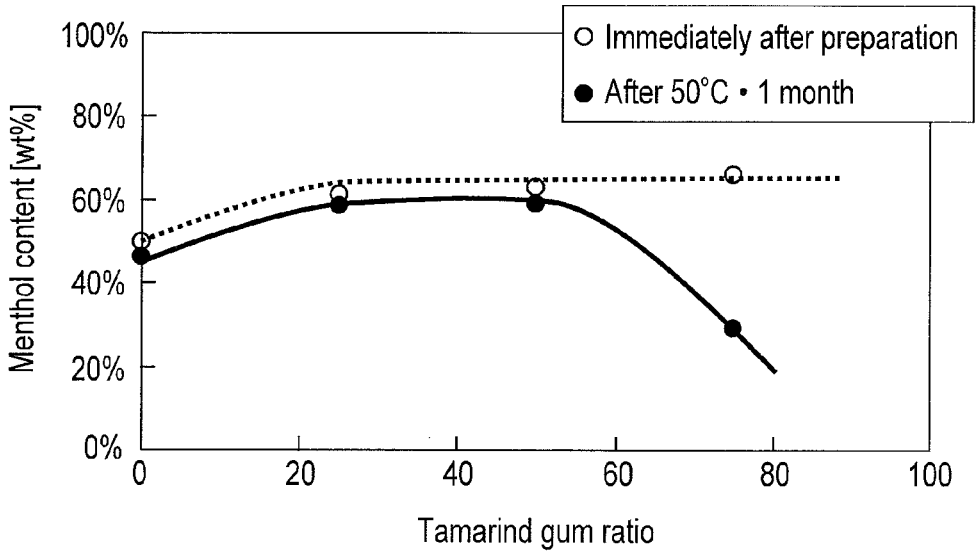
FIG. 9 is a graph showing a relationship between the blending ratio of tamarind gum and the menthol content of the sheets containing gellan gum and tamarind gum in the case where the raw material slurries are left to stand after the preparation.

The menthol content of the sheet immediately after preparation (the initial menthol content) and the menthol content of the sheet stored in accelerated environments (the post-storage menthol content) were measured. The accelerated environments were as described in Example 1. The measurement of the menthol content was performed by the same procedure as Example 1. The Measurement Results are Shown in FIG. 9 as a relationship between the blending ratio of tamarind gum and the menthol content. In FIG. 9, the term "immediately after preparation" means a sheet immediately after the preparation, and the term "after 50° C.·1 month" means a sheet after storage at 50° C. for 30 days.

11-3. Results

As shown in FIG. 9, in this example (that is, in the case where the raw material slurry was prepared and left to stand for a predetermined time, and then a sheet was prepared), the sheet having 0% blending ratio of tamarind gum (gellan gum containing sheet) had the initial menthol content of about 50% and the post-storage menthol content of about 46%. On the other hand, in the case where the sheet was prepared immediately after the preparation of the raw material slurry as shown in FIG. 7A, the sheet having 0% blending ratio of tamarind gum had the initial menthol content of about 67% and the post-storage menthol content of about 70%. Thus, if the raw material slurry containing only gellan gum as polysaccharide was left to stand after the preparation, the emulsified state of the raw material became slightly unstable. This led to a decrease in the initial menthol content.

In this example, the sheet containing tamarind gum at a blending ratio of 25% had the initial menthol content of about 61% and the post-storage menthol content of about 58%. The sheet containing tamarind gum at a blending ratio of 50% had the initial menthol content of about 63% and the post-storage menthol content of about 59%. Thus, when the tamarind gum was contained at a predetermined ratio in the raw material slurry, the emulsified state of the raw material was stably maintained and high menthol content was maintained after storage, even if the raw material slurry was left to stand after the preparation.

In this example, the sheet containing tamarind gum at a blending ratio of 75% had the initial menthol content of about 66% and the post-storage menthol content of about 29%. This result was the same as the case where the sheet is prepared immediately after the preparation of the raw material slurry (see FIG. 7A). This is considered to be due to the fact that the blending ratio of tamarind gum is high.

The above results show that gellan gum and tamarind gum are preferably used at a mixing ratio (weight ratio) of 50:50 to 75:25 as polysaccharide in order to stably maintain the emulsified state of the raw material after the preparation of the raw material slurry. In other words, when gellan gum and tamarind gum are contained at a mixing ratio (weight ratio) of 50:50 to 75:25 in the raw material slurry, the sheet can maintain high menthol content even after storage, even if the raw material slurry is prepared in advance, and then the sheet is prepared according to demand by heating the raw material again. This enables the raw material slurry to be prepared in advance and kept for a long time.

When the results of Examples 9 to 11 are summarized, gellan gum and tamarind gum are preferably used at a weight ratio of 50:50 to 75:25 in order to satisfy both of high post-storage flavor-retaining properties and high emulsion stability.

Example 12

In this example, an effect of the type of emulsifier on the post-storage menthol content of the menthol-containing sheet was examined.

12-1. Method (Preparation of Sheet and Measurement of Menthol Content)

Sheets containing gellan gum and tamarind gum were prepared using raw material slurries containing various types of emulsifiers. The sheet preparation was performed in accordance with the same procedure as Example 9. The mixing ratio (weight ratio) of gellan gum and tamarind gum was 1:1.

Eight types of emulsifiers below were used as the emulsifier. The numbers 1 to 8 given to the emulsifiers below correspond to the number of FIG. 10.

Figure 10:
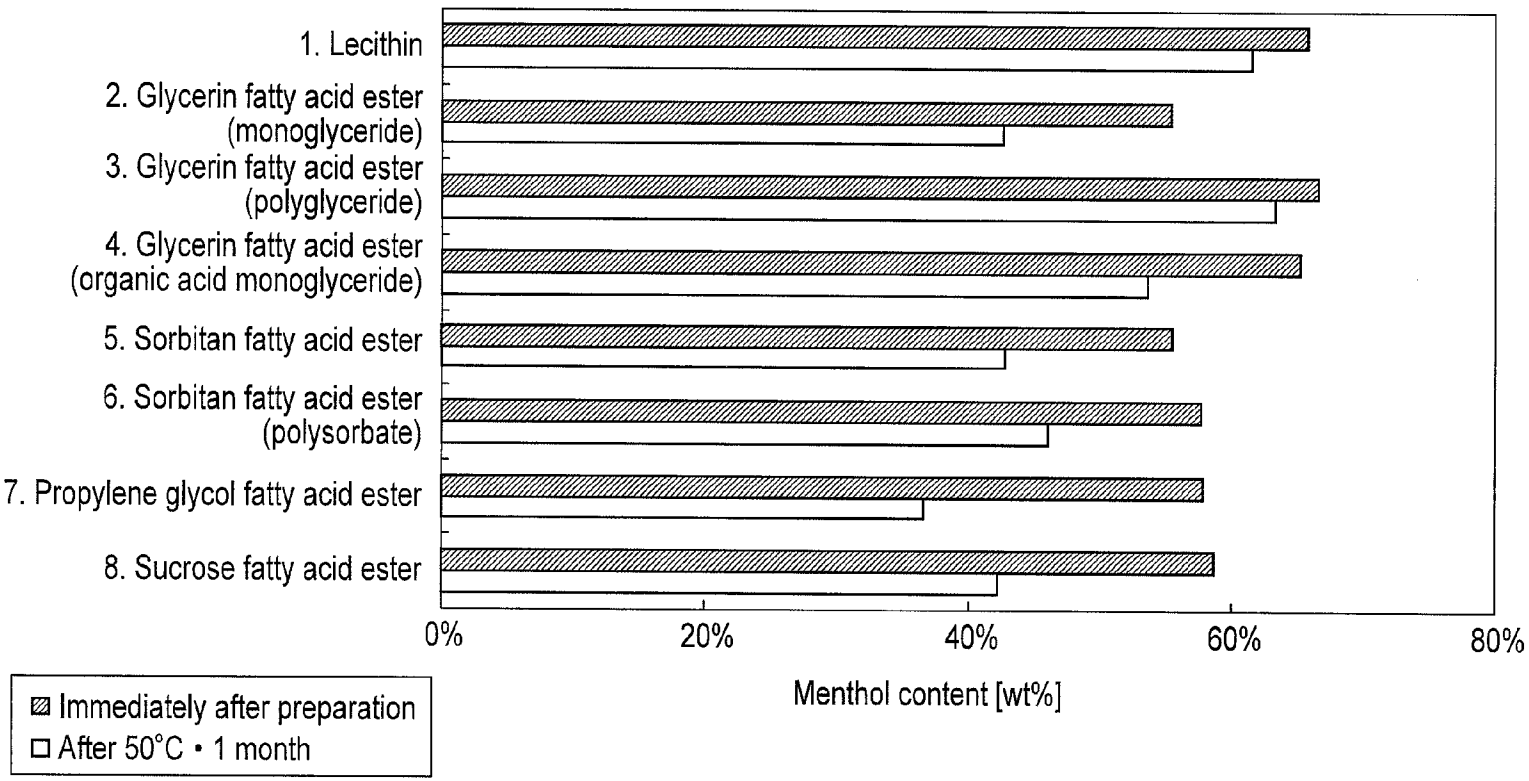
FIG. 10 is a graph showing effects of the type of emulsifier on the menthol content of the sheets containing gellan gum and tamarind gum.

1. Lecithin
   (SUN LECITHIN A-1, manufactured by Taiyo Kagaku Co., Ltd.)
2. Glycerin fatty acid ester (monoglyceride)
   (Exel S-95, manufactured by Kao Corporation)
   Compound name: lipophilic glycerin monostearate
3. Glycerin fatty acid ester (polyglyceride)
   (A-181E, manufactured by Taiyo Kagaku Co., Ltd.)
   Compound name: pentaglycerin monostearate
4. Glycerin fatty acid ester (organic acid monoglyceride)
   (Step SS, manufactured by Kao Corporation)
   Compound name: monoglyceride succinate
5. Sorbitan fatty acid ester
   (Emasol S-10V, manufactured by Kao Corporation)
   Compound name: sorbitan monostearate
6. Sorbitan fatty acid ester (polysorbate)
   (Emasol S-120V, manufactured by Kao Corporation)
   Compound name: polyoxyethylenesorbitan monostearate
7. Propylene glycol fatty acid ester (Sunsoft No. 25CD, manufactured by Taiyo Kagaku Co., Ltd.)
   Compound name: propylene glycol monostearate
8. Sucrose fatty acid ester
   (Ryoto sugar ester S-1570, manufactured by Mitsubishi-Kagaku Foods Corporation)
   Compound name: sucrose stearic acid ester The menthol content of the sheet immediately after preparation (the initial menthol content) and the menthol content of the sheet stored in accelerated environments (the post-storage menthol content) were measured. The accelerated environments were as described in Example 1. The measurement of the menthol content was performed in accordance with the same procedure as Example 1. The measurement results of the menthol content are shown in FIG. 10. In FIG. 10, the term "immediately after preparation" means a sheet immediately after the preparation, and the term "after 50° C.·1 month" means a sheet after storage at 50° C. for 30 days.

12-2. Results

The results of FIG. 10 show that it is possible to use various emulsifiers in addition to lecithin. In the preparation of the sheet containing gellan gum and tamarind gum, it is particularly preferable to use 1. lecithin, 3. glycerin fatty acid ester (polyglyceride), and 4. glycerin fatty acid ester (organic acid monoglyceride) as emulsifiers.

Example 13

In this example, an effect of the concentration of polysaccharide on the post-storage menthol content of the menthol-containing sheets was examined.

13-1. Method (Temperature-Responsive Sol-Gel Transition Characteristics)

In this experiment, temperature-responsive sol-gel transition characteristics of raw material slurries (sheet preparation fluid) containing polysaccharide (a mixture of gellan gum and tamarind gum) at various concentrations were examined. As the polysaccharide, gellan gum and tamarind gum were used at a weight ratio of 1:1. 1 part by weight (1%), 2 parts by weight (2%), 3 parts by weight (3%), 5 parts by weight (5%), and 7 parts by weight (7%) of the polysaccharide (a mixture of gellan gum and tamarind gum) were used based on water (100 parts by weight). In the following description and FIGS. 11A to 11C, the concentration of polysaccharide is represented by weight percent (%) based on water.

Raw material slurries containing gellan gum and tamarind gum as the polysaccharide were prepared according to the description of Example 9. Depending on the concentrations of polysaccharide, menthol was added in an amount 5 times as much as polysaccharide (weight ratio), and the 5% aqueous lecithin solution was added in an amount two-fifths times as much as polysaccharide (weight ratio).

The temperature of the raw material slurries containing polysaccharide at various concentrations was decreased from 70° C. to 25° C. for about 900 seconds. Thereafter, the temperature was raised to 70° C. for about 900 seconds. Changes in the viscosity (fluidity) of the slurries followed by the fall and rise in temperature were measured with a rheometer (RheoStress 1, manufactured by Thermo-Haake). The results are shown in FIGS. 11A and 11B.

13-2. Results (Temperature-Responsive Sol-Gel Transition Characteristics)

Figure 11A:
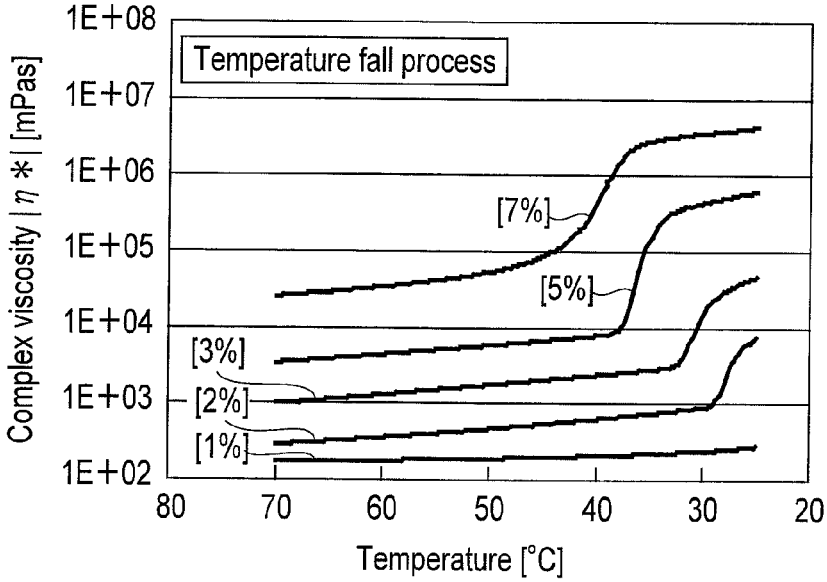
FIG. 11A is a graph showing changes in the viscosity followed by a fall in the temperature of raw material slurries containing polysaccharide (a mixture of gellan gum and tamarind gum) at various concentrations.
Figure 11B:
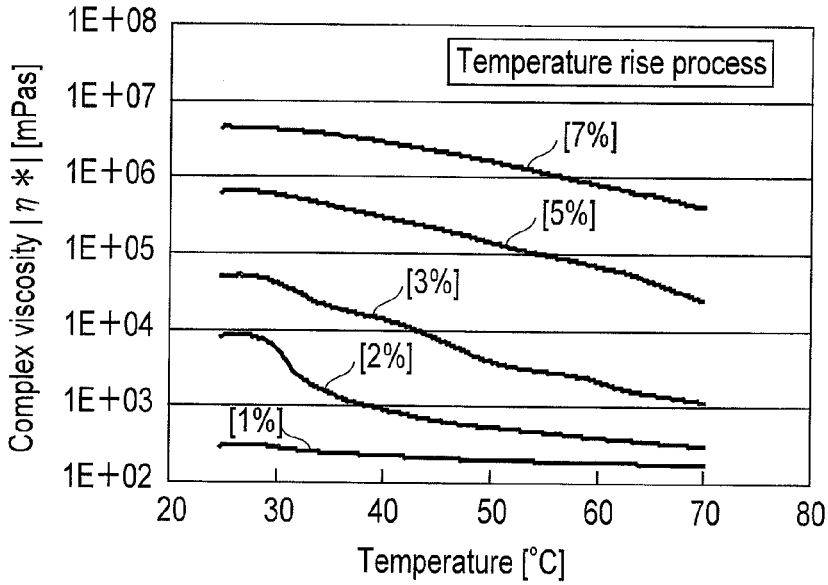
FIG. 11B is a graph showing changes in the viscosity followed by a rise in the temperature of raw material slurries containing polysaccharide (a mixture of gellan gum and tamarind gum) at various concentrations.

As shown in FIG. 11A, in the case of the raw material slurry containing 1 wt % of polysaccharide, even if the slurry was cooled to 25° C., it was not sufficiently gelatinized. When the temperature of this raw material was increased afterward, it was difficult to maintain the gel state. Particularly, as shown in FIG. 11B, once the raw material slurries containing 5 to 7 wt % of polysaccharide were cooled and formed gel, they could maintain the gel state without easily returning to a sol state even if they were heated at a temperature exceeding the transition temperature afterward.

Thus, it was shown that the raw material slurry containing gellan gum and tamarind gum as polysaccharide had "temperature-responsive sol-gel transition characteristics".

13-3. Method (Preparation of Sheet and Measurement of Menthol Content)

Menthol-containing sheets were prepared using raw material slurries containing polysaccharide at various concentrations (see the column of 13-1). The sheet preparation was performed in accordance with the same procedure as Example 9.

The menthol content of the sheet immediately after preparation (the initial menthol content) and the menthol content of the sheet stored in accelerated environments (the post-storage menthol content) were measured. The accelerated environments were as described in Example 1. The measurement of the menthol content was performed in accordance with the same procedure as Example 9. The results are shown in FIG. 11C.

13-4. Results (Menthol Content)

Figure 11C:
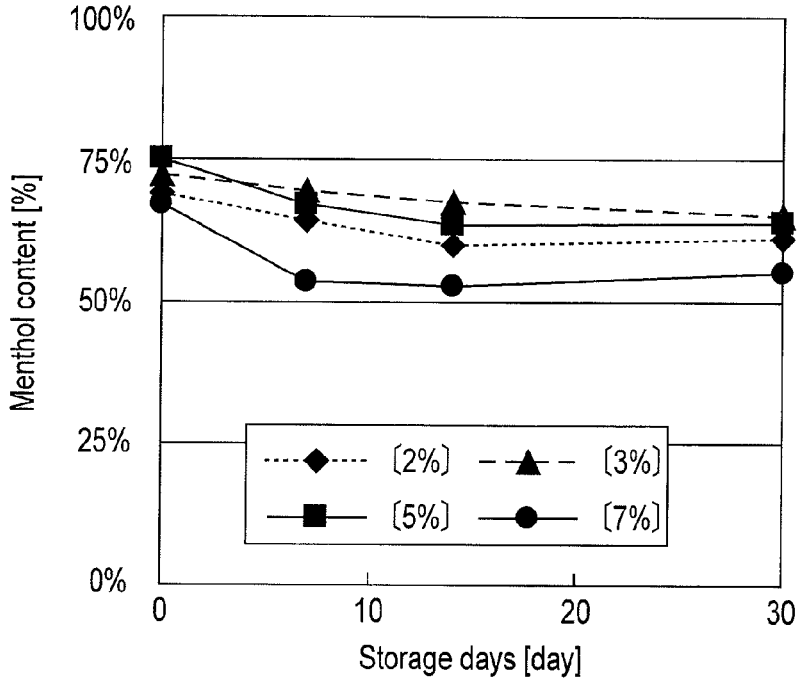
FIG. 11C is a graph showing the post-storage menthol content of menthol-containing sheets prepared using raw material slurries containing polysaccharide (a mixture of gellan gum and tamarind gum) at various concentrations.

As shown in FIG. 11C, in all cases where the concentrations of polysaccharide were 2 wt %, 3 wt %, 5 wt %, and 7 wt %, the initial menthol content was about 70 wt %, and the menthol content after storage for 30 days was in the range of 55 to 65 wt % (menthol flavor retention rate=82 to 90%). Among the cases, when the concentrations of polysaccharide were 3 wt % and 5 wt %, the menthol content after storage for 30 days was particularly high and 65 wt % and 64 wt %, respectively.

These results show that the polysaccharide is contained in the raw material slurry at a concentration of preferably 2 to 7 wt %, more preferably 3 to 5 wt %.

Example 14

In this example, an effect of the blending ratio of menthol contained in the raw material slurry on the post-storage menthol content and the menthol yield of the menthol-containing sheets was examined.

14-1. Method (Preparation of Sheet and Measurement of Menthol Content)

Sheets containing gellan gum and tamarind gum were prepared using raw material slurries having various blending ratios of menthol. The sheet preparation was performed in accordance with the same procedure as Example 9. As the polysaccharide, gellan gum and tamarind gum were used at a weight ratio of 1:1.

3 parts by weight (weight percent (%) based on water=3%) of the polysaccharide (a mixture of gellan gum and tamarind gum) was used based on water (100 parts by weight). Menthol was added in an amount equivalent to 0.5, 1, 2.5, 5, 10, 15, and 20 times the weight of 3 parts by weight of polysaccharide in the raw material slurry.

The menthol content of the sheet immediately after preparation (the initial menthol content) and the menthol content of the sheet stored in accelerated environments (the post-storage menthol content) were measured. The accelerated environments were as described in Example 1. The measurement of the menthol content was performed in accordance with the same procedure as Example 9. The results are shown in FIGS. 12A to 12E. In the drawings, the expression [1:x] represents weight ratios of polysaccharide and menthol in the raw material slurry. For example, the expression [1:5] represents that menthol is contained in the raw material slurry in an amount equivalent to 5 times the weight of polysaccharide. In these drawings, the term "immediately after preparation" means a sheet immediately after the preparation, and the term "after 50° C.·1 month" means a sheet after storage at 50° C. for 30 days.

14-2. Results

Figure 12A:
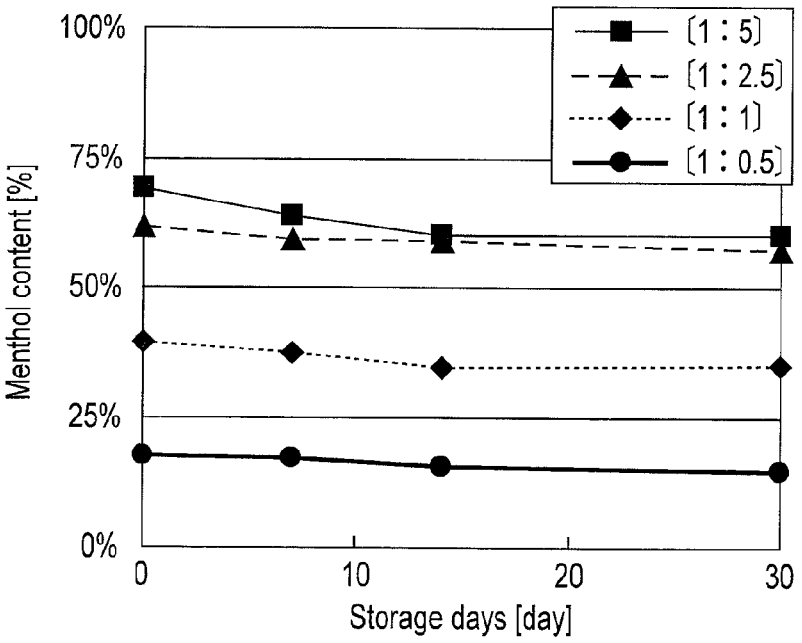
FIG. 12A is a graph showing the post-storage menthol content of menthol-containing sheets prepared using raw material slurries containing polysaccharide (a mixture of gellan gum and tamarind gum) and menthol at various ratios.
Figure 12B:
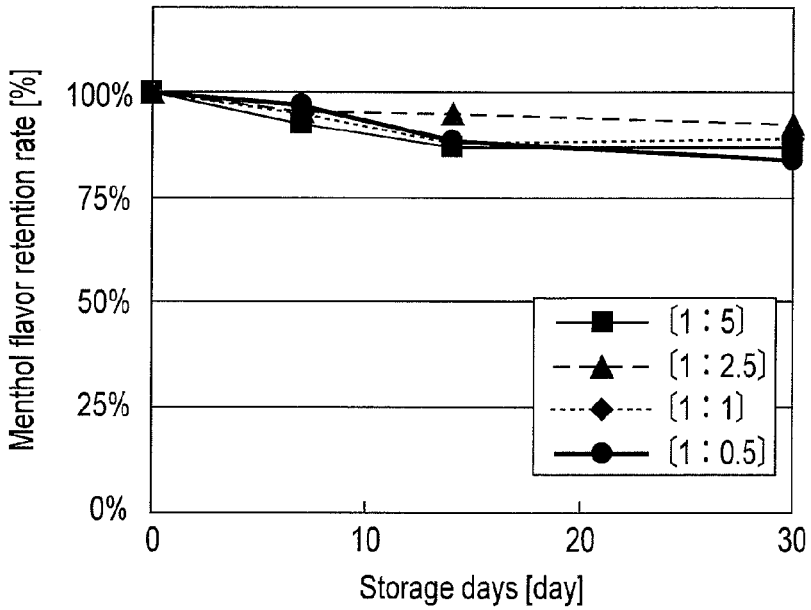
FIG. 12B is a graph showing the menthol flavor retention rates of menthol-containing sheets prepared using raw material slurries containing polysaccharide (a mixture of gellan gum and tamarind gum) and menthol at various ratios.

As shown in FIG. 12A, the "initial menthol content" was the highest in the case of the sheet containing menthol in 5-fold weight and the lowest in the case of the sheet containing menthol in 0.5-fold weight, and thus it was dependent on the blending amount of menthol. In all cases of the blending amounts of menthol, the "post-storage menthol content" was hardly reduced from the initial menthol content. Thus, as shown in FIG. 12B, the menthol flavor retention rate after storage for 30 days showed a high value of 84 to 93% in all cases of the blending amounts of menthol. Among them, the sheet containing menthol in 2.5-fold weight exhibited the highest menthol flavor retention rate.

Figure 12C:
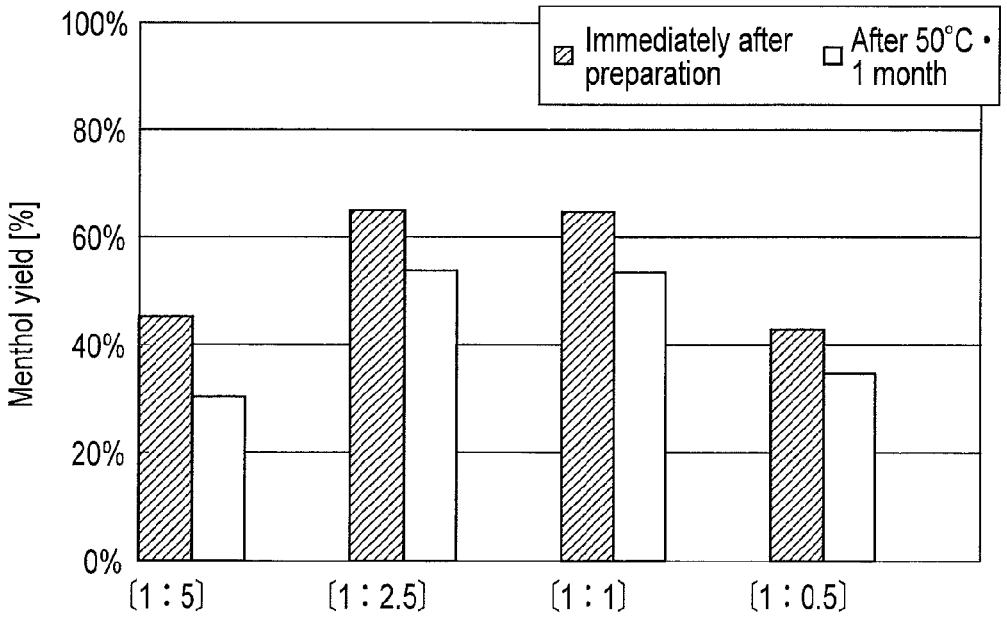
FIG. 12C is a graph showing menthol yields of menthol-containing sheets prepared using raw material slurries containing polysaccharide (a mixture of gellan gum and tamarind gum) and menthol at various ratios.

As shown in FIG. 12C, the "menthol yield" immediately after the sheet preparation showed the highest value of 65% in the case of the sheets containing menthol in 1- and 2.5-fold weight. The "menthol yield" after storage showed the highest value of 54% in the case of the sheets containing menthol in 1- and 2.5-fold weight. The sheet containing menthol in 5-fold weight showed a lower "menthol yield" after storage than that of the sheet containing menthol in 2.5-fold weight, but the menthol content in the sheet (absolute amount) is higher (see FIG. 12A).

Figure 12D:
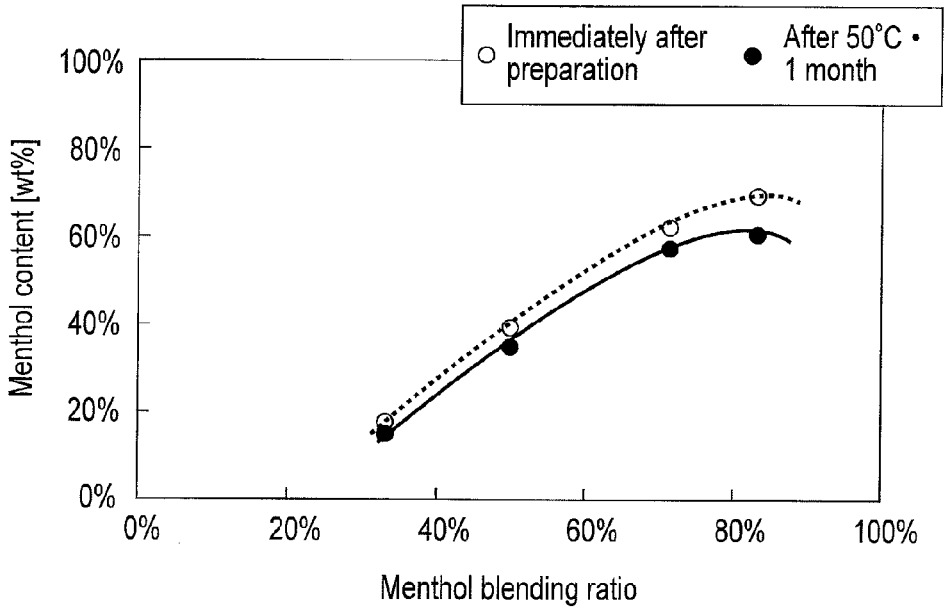
FIG. 12D is a graph showing a relationship between the blending ratio of menthol and the menthol content of the menthol-containing sheet (the case where gellan gum and tamarind gum are used in combination as polysaccharide).
Figure 12E:
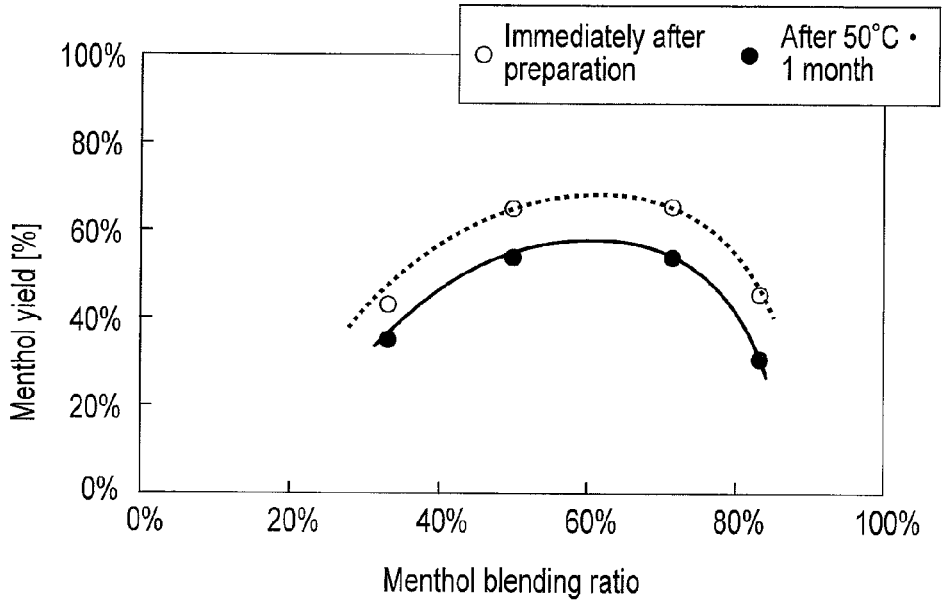
FIG. 12E is a graph showing a relationship between the blending ratio of menthol and the menthol yield of the menthol-containing sheet (the case where gellan gum and tamarind gum are used in combination as polysaccharide).

FIGS. 12D and 12E show a relationship between the blending ratio (%) of menthol and the menthol content (%) and a relationship between the blending ratio (%) of menthol and the menthol yield (%), respectively. In the drawings, the blending ratio of menthol (%) is represented by the formula: {blending amount of menthol/(blending amount of menthol+blending amount of gellan gum)}×100.

As shown in FIG. 12D, the sheets in which the blending amount of menthol was 2.5 to 5-fold weight (i.e., the blending ratio of menthol is from 71 to 83%) showed a high menthol content after storage. As shown in FIG. 12E, the sheets in which the blending amount of menthol was 1 to 2.5-fold weight (i.e., the blending ratio of menthol is from 50 to 71%) showed a high menthol yield after storage.

These results show that the blending amount of menthol to polysaccharide is preferably 1 to 5-fold weight, more preferably 2.5 to 5-fold weight.

What is claimed is:

1. A method for preparing a flavor-containing sheet for a smoking article, comprising:

a step of extending a raw material slurry on a substrate, wherein the slurry contains polysaccharide consisting of gellan gum and tamarind gum, a flavor, an emulsifier and 70 to 95 wt % of water, has a weight ratio of gellan gum to tamarind gum of 1:1 to 3:1, and has a temperature of 60 to 90° C., thereby existing in a sol state;

a step of cooling the extended raw material slurry to a sample temperature of 0 to 30° C. to form a gel; and a heat-drying step comprising heating the gelled raw material and drying it at a sample temperature of 70 to 100° C.

2. The method for preparing a flavor-containing sheet for a smoking article according to claim 1, wherein the emulsifier is lecithin.

3. The method for preparing a flavor-containing sheet for a smoking article according to claim 1, wherein the flavor content of the sheet after preparation is 45 wt % or more, and the flavor content of the sheet after storage at 50° C. for 30 days is 45 wt % or more.

4. The method for preparing a flavor-containing sheet for a smoking article according to claim 1, wherein the flavor is menthol.

5. The method for preparing a flavor-containing sheet for a smoking article according to claim 4, wherein the menthol content of the sheet after preparation is 45 wt % or more, and the menthol content of the sheet after storage at 50° C. for 30 days is 45 wt % or more.

6. The method for preparing a flavor-containing sheet for a smoking article according to claim 1, wherein the heat-drying step is performed for a total heat-drying time of 20 minutes or less.

7. The method for preparing a flavor-containing sheet for a smoking article according to claim 1, wherein the step of cooling is conducted at a temperature of 15-25° C.

* * * * *